US012359451B2

(12) United States Patent
Schmid

(10) Patent No.: US 12,359,451 B2
(45) Date of Patent: Jul. 15, 2025

(54) ASSEMBLY CONSISTING OF A CLIMBING RAIL AND A CLIMBING LIFT RAIL FOR A RAIL-GUIDED

(71) Applicant: PERI SE, Weissenhorn (DE)

(72) Inventor: Josef Schmid, Balzheim (DE)

(73) Assignee: PERI SE, Weissenhorn (DE)

( * ) Notice: Subject to any disclaimer, the term of this patent is extended or adjusted under 35 U.S.C. 154(b) by 784 days.

(21) Appl. No.: 17/616,726

(22) PCT Filed: Jun. 3, 2020

(86) PCT No.: PCT/EP2020/065330

§ 371 (c)(1),
(2) Date: Dec. 6, 2021

(87) PCT Pub. No.: WO2020/245185

PCT Pub. Date: Dec. 10, 2020

(65) Prior Publication Data

US 2022/0325541 A1 Oct. 13, 2022

(30) Foreign Application Priority Data

Jun. 6, 2019 (DE) ..... 102019115346.8

(51) Int. Cl.

| | |
|---|---|
| ***E04G 11/28*** | (2006.01) |
| ***E04G 3/20*** | (2006.01) |
| ***E04G 3/28*** | (2006.01) |
| ***E04G 21/32*** | (2006.01) |

(52) U.S. Cl.

CPC ..... *E04G 11/28* (2013.01); *E04G 3/20* (2013.01); *E04G 3/28* (2013.01); *E04G 21/3247* (2013.01); *E04G 2003/286* (2013.01)

(58) Field of Classification Search

CPC ..... E04G 3/20; E04G 3/28; E04G 2003/286; E04G 11/28; E04G 21/3247

See application file for complete search history.

(56) References Cited

U.S. PATENT DOCUMENTS

| | | | | |
|---|---|---|---|---|
| 7,513,480 | B2 * | 4/2009 | Bergaretxe | E04G 11/28 249/20 |
| 11,408,188 | B1 * | 8/2022 | Magnusen | E04G 11/28 |
| 2003/0052249 | A1 * | 3/2003 | Waldschmitt | E04G 11/28 249/20 |
| 2009/0173574 | A1 * | 7/2009 | Hobmeier | E04G 11/28 182/82 |

(Continued)

FOREIGN PATENT DOCUMENTS

| | | | | |
|---|---|---|---|---|
| CA | 2718609 | A1 | 10/2009 | |
| CA | 2870412 | A1 * | 5/2015 | E04G 11/28 |

(Continued)

*Primary Examiner* — Jessie T Fonseca

(74) *Attorney, Agent, or Firm* — SLEMAN & LUND LLP

(57) ABSTRACT

An assembly consisting of a climbing rail and a climbing lift rail, which can be moved relative to the climbing rail and is guided by the climbing rail, for a rail-guided climbing system which can be used in particular as a climbing formwork, a climbing frame, a climbing protection wall, and/or a climbing working platform and which comprises climbing shoes that can be arranged on a building structure in a stationary manner and a lifting device that is fixed to the climbing rail at one end and to the climbing lift rail at the other end.

19 Claims, 12 Drawing Sheets

(56) References Cited

U.S. PATENT DOCUMENTS

2018/0245357 A1* 8/2018 Gruebler ..... E04G 11/28

FOREIGN PATENT DOCUMENTS

| | | | | |
|---|---|---|---|---|
| CN | 101360872 | A | 2/2009 | |
| CN | 103635643 | A | 3/2014 | |
| DE | 102006055374 | | 7/2008 | |
| DE | 102018202097 | | 8/2019 | |
| GB | 2426278 | A | 11/2006 | |
| KR | 20090020246 | A | 2/2009 | |
| WO | WO-2007000136 | A1 * | 1/2007 | ..... B66F 11/04 |
| WO | WO-2007141264 | A1 * | 12/2007 | ..... E04G 11/28 |
| WO | 2009117986 | A1 | 10/2009 | |
| WO | 2018190584 | | 10/2018 | |
| WO | 2020020412 | | 1/2020 | |

* cited by examiner

ASSEMBLY CONSISTING OF A CLIMBING RAIL AND A CLIMBING LIFT RAIL FOR A RAIL-GUIDED

FIELD

The invention relates to an assembly consisting of a climbing rail and a climbing lift rail, which can be moved relative to the climbing rail and is guided by the climbing rail, for a rail-guided climbing system which can be used in particular as a climbing formwork, a climbing frame, a climbing protection wall, and/or a climbing working platform, wherein the climbing system comprises climbing shoes that can be arranged on a building structure in a stationary manner and a lifting device that is fixed to the climbing rail at one end and to the climbing lift rail at the other end. The invention further relates to a rail-guided climbing system having said assembly and a method for climbing a rail-guided climbing system which can be used in particular as a climbing formwork, a climbing frame, a climbing protection wall, and/or a climbing working platform, having said assembly.

BACKGROUND

A rail-guided self-climbing formwork system is described in the international laid-open application WO 2009/117986 A1 as the prior art for a climbing system. In the construction industry, climbing systems are used, e.g., in the construction of vertically oriented concrete structures, in particular so-called building cores, bridges, dams, and the like, as climbing formwork and/or climbing protection walls and/or in the form of climbing frames. The climbing systems are usually provided with a working platform as a frame unit and can be moved independently of a crane from a lower completed concrete wall portion of the concrete structure to be created or completed to a further hardened concreting portion of the concrete structure arranged above. Subsequently, a climbing rail, which is moved upwards, i.e., climbed, via a hydraulic cylinder that is supported on a climbing shoe. Alternatively, a work console or a working platform can be raised by means of climbing cylinders which are attached to a climbing console, which is fastened by means of anchor bolts to a concrete wall, below the work console and to the work console. Crane climbing systems that work without hydraulic cylinders are also known.

The disadvantage of the known lift drives for climbing systems is that the hydraulic cylinder has to be carried every time to the next highest floor for the next climbing portion or concreting portion. Depending on the lift drive used, a leading rail may also be necessary, which must be manually attached to the building structure, wherein the climbing direction must be switched manually on the climbing system in order to pull up the rail. The manual effort is therefore high after each lifting process, wherein continuous climbing is not possible.

The climbing systems provided with a working platform as a frame unit can only be used for formworking after moving from a lower completed concrete wall portion to a further concreting portion of the concrete structure arranged above when the further concreting portion is completely hardened. Only then can a climbing shoe reliably absorb the vertical load of the climbing rail to which the frame unit is attached. The wait for the entire hardening time of the concrete before the next formworking process takes time and thus increases the costs at the construction site. However, if the formworking were to take place while the climbing rail is supported on a climbing shoe anchored in a not fully hardened concreting portion, it could result in the climbing shoe shifting in the concrete due to the insufficient load-bearing capacity of the concrete and, in the worst case, lead to the climbing rail with the frame unit falling off the climbing shoe.

Summary

In contrast, the problem addressed by the present invention is that of providing an assembly, constructed in a simple and compact manner, having a climbing rail for a climbing system, which allows for step-by-step, continuous climbing without high manual effort after each lifting process such that, after completion of the climbing process and without waiting for the entire hardening time of the last completed concreting portion, the next concreting portion to be completed can be shuttered with the climbing system. In particular, the assembly having a climbing rail for a climbing system is supposed to make it possible to shutter the next concreting portion to be completed immediately after climbing over a last completed, not yet fully hardened concreting portion.

This problem is solved by an assembly having a climbing rail and a method for climbing a rail-guided climbing system.

The problem according to the invention is thus solved by an assembly consisting of a climbing rail and a climbing lift rail, which can be moved relative to the climbing rail and is guided by the climbing rail, for a rail-guided climbing system which can be used in particular as a climbing formwork, a climbing frame, a climbing protection wall, and/or a climbing working platform, wherein the climbing system comprises climbing shoes that can be arranged on a building structure in a stationary manner and a lifting device that is fixed to the climbing rail at one end and to the climbing lift rail at the other end, wherein the climbing rail is guided by the climbing shoes, wherein the climbing rail and the climbing lift rail can each be suspended on at least one of the climbing shoes in the direction opposite the climbing direction and can be unhooked from the at least one of the climbing shoes in the climbing direction and moved relative to the at least one of the climbing shoes, wherein a fixing means is provided in order to fix the climbing rail and the climbing lift rail to each other in a reversibly releasable manner independently of a fixation to each other by means of the lifting device.

According to the invention, a climbing lift rail is thus provided as a unit which is connected to the climbing rail via the lifting device and guided by the climbing rail and movable with respect to the climbing rail. Therefore, a climbing lift rail, which is restricted in its movement by the climbing rail and moves up and down with respect to the climbing rail, is movably connected to the climbing rail. The climbing lift rail is held or guided on the climbing rail, for example, via guide shoes of the climbing rail. A movement of the climbing lift rail with respect to the climbing rail is realized by a retractable and extendable lifting device. The lifting device can be releasably fixed at its upper or lower end, i.e., on one end, to the climbing rail, wherein, at its lower or upper end, i.e., on the other end, the lifting device can have an engagement and fastening tab that is firmly connected to, i.e., not easily detachable from, the climbing rail. The climbing direction can indicate an upward direction, wherein a sideways direction is also possible, for example, in tunnel construction. Inclined linear translational or also curved, for example, rotatory directions, are also possible as a climbing direction.

For achieving an upward movement of the climbing rail when the lifting device is both extended and retracted, the length of the stroke of the lifting device can be selected such that it is sufficient to suspend the climbing rail offset by a suspension distance of the climbing rail. Depending on the design of the connection between the climbing shoe and the climbing rail for suspending the climbing rail, at least one suspension distance of the climbing rail and, in addition, a climbing shoe travel path must preferably be traversed by the lifting device when the climbing lift rail is suspended. In the case of a climbing shoe, the climbing shoe travel path in the climbing direction is used to effect a suspending on the climbing shoe after said travel path was traversed at a movement in the direction opposite the climbing direction. With the upward movement of the climbing rail in relation to the building when the lift device is extended and the upward movement of the climbing lift rail in relation to the climbing rail when the lift device is retracted, a continuous climbing of the frame unit is achieved in a simple manner. The lift drive according to the invention thus climbs along due to its lifting movements. Since the climbing rail and the climbing lift rail can each be suspended on at least one of the climbing shoes in one direction and unhooked in the direction opposite said direction and moved with respect to the at least one of the climbing shoes, a manual effort can be forgone for each step of extending and retracting the lift device. The lifting device no longer has to be dismantled and carried to the next highest floor for the next climbing portion or concreting portion.

The climbing lift rail is guided by the climbing rail when the climbing lift rail is moved relative to the climbing rail, so that it is ensured that the respective expansions of the climbing rail and the climbing lift rail in the longitudinal direction do not add up even when the lifting device is fully extended, which results in a compact design of the lift drive. Since the lifting device can remain fixed at one end to the climbing rail and at the other end to the climbing lift rail both when it retracts and extends and, apart from guiding the climbing rail and the independent fixing means for reversibly releasable fixation of the climbing rail and the climbing lift rail to each other, the climbing lift rail is connected to the climbing rail only via the lifting device, the lift drive is designed in a very simple manner and can be realized in a correspondingly cost-effective manner, operated with little loss and is not susceptible to repairs.

If the climbing lift rail is fixed to the climbing rail in a reversibly releasable manner by the fixing means according to the invention, a vertical load of the climbing rail, for example, a frame unit and/or protective wall into which the at least one climbing rail is integrated or to which the at least one climbing rail is attached, can be diverted via the fixing means, the climbing lift rail and a climbing shoe, on which the climbing lift rail is suspended, into the structure. This state can last for the duration of formworking carried out by means of the climbing system, since the lifting device does not have to fix the climbing lift rail to the climbing rail and is therefore freed from the vertical load to be introduced into the structure and suspended on the climbing rail. The lifting device can consequently be dimensioned such that it only has to accompany the climbing process, but not the formworking process that follows the climbing process.

If the climbing lift rail is suspended on at least one climbing shoe during operation of the climbing system, the climbing lift rail is reversibly releasable and, independently of any further fixation of both rails by the lifting device, i.e., independently with respect to the lifting device, fixed to the climbing rail by means of the fixing means in order to be able to start formworking immediately thereafter. The fixing means is independent of the lifting device, i.e., mechanical, with regard to the fixing effect of the two rails to each other. The fixing means can therefore also fix both rails to each other in a reversibly releasable manner when the lifting device is not in operation or, in other words, if there were no lifting device. However, there may be a temporal dependence of the fixation by the fixing means on the operation of the lifting device. Operation of the fixing means can therefore depend, in terms of time and technical control, on an operating state of the lifting device or a movement of the lifting device.

The climbing shoe on which the climbing rail was suspended before the climbing lift rail was suspended by extending the lifting device, whereby the climbing rail was unhooked, can be located further in the climbing direction than the climbing shoe on which the climbing lift rail is suspended when the lifting device is extended. According to the invention, it is provided that the climbing shoe, on which the climbing rail was suspended before the climbing lift rail was suspended by extending the lifting device, is anchored in concrete that has not yet fully hardened, and the climbing shoe, on which the climbing lift rail is suspended on the climbing rail with a fixation independent of the lifting device, is anchored in a previously completed concreting portion with fully hardened concrete. In this case, the next concreting portion to be completed can be shuttered with the climbing system immediately after climbing over the last completed, not fully hardened concreting portion, which is indicated by the suspension of the climbing rail on the climbing shoe of this concreting portion, because, during formworking, the vertical load of the climbing system is not diverted into this climbing shoe, but into the next climbing shoe which is arranged relative to this climbing shoe against the climbing direction and anchored in an already fully hardened concreting portion.

Once the climbing rail is suspended on the next climbing shoe of a fresh and therefore not yet fully hardened concreting portion, no vertical loads occur in this shoe during a formworking process for formworking the next not yet concreted concreting portion because, starting from the use of the fixation independent of the lifting device, for example, in the form of a latch, i.e., the fixation of the climbing rail and the climbing lift rail to each other independently of the lifting device, no vertical loads whatsoever have to be diverted into the climbing shoe, which is anchored in the fresh concreting portion, during the formworking process. By closing the latch, the vertical loads are diverted into a climbing shoe which is located in a fully hardened concreting portion located and arranged below the climbing shoe of the fresh concreting portion. This allows for formwork to be applied to the next concreting portion as early as possible.

The assembly according to the invention thus makes it possible to suspend the climbing rail briefly on a climbing shoe of a not yet fully hardened concreting portion and then to suspend the climbing lift rail in another climbing shoe of an already fully hardened concreting portion arranged opposite the climbing direction, for example, in a multistory structure, below this climbing shoe, and to connect the climbing rail to the climbing lift rail by means of the reversibly detachable fixation such that the lifting device is relieved and formworking can take place in the thus fixed state.

The climbing rail and the climbing lift rail are advantageously coupled to each other in a manually or automatically fixable manner via the fixing means. A manual fixation is simple, cost-effective and less maintenance-intensive than a possibly technically more complex automatic fixation. On the other hand, an automatic fixation eliminates sources of human error and does not tie up valuable working time.

In one embodiment, the fixing means is designed as a latching or snap connection and comprises at least one latching/snap element and at least one retaining element for holding the at least one latching/snap element. In particular, the fixing means can comprise either the at least one latching/snap element and a plurality of the retaining elements or a plurality of the latching/snap elements and the at least one retaining element for holding the at least one latching/snap element of the plurality of latching/snap elements. Latching or snap connections as fixing means have a simple design, are cost-effective, low-maintenance and reliable.

In particular, if the latching/snap element is designed as a movable element, designed in particular to be pivotable, foldable or movable, in the form of a latch, in particular a locking latch or fixing latch, a detent, in particular a snap-in nose, a bolt, in particular a locking bolt, or a slide, the result is a simple and therefore reliable and low-maintenance fixing means.

The retaining elements in the form of fixing recesses for meshing with the at least one latching/snap element fixed to the climbing rail can be introduced one behind the other into the climbing lift rail, or retaining knobs can be applied, for example, welded, to the climbing lift rail. This results in a compact and cost-effective solution for the fixing means.

The climbing lift rail can advantageously have the fixing recesses on at least one side such that the climbing lift rail is present in the form of a profile with a suspension contour, in particular with teeth, or, in particular if only one latching/snap element is fixed to the climbing rail, the climbing lift rail has the fixing recesses in the form of completely edged holes, also called ears, which are, for example, square, in particular rectangular or square. The climbing lift rail then serves not only as an alternative to the climbing rail for suspending on and/or unhooking from a climbing shoe, but also to accommodate the fixing recesses as part of the fixing means. In this case, the fixing recesses can be introduced in one working step with the introduction of the contour for suspending on and/or unhooking from a climbing shoe, which reduces the production costs when compared to multi-stage processing and the material costs when compared to separate elements for the climbing lift rail and the fixing recesses. Instead of the climbing lift rail, the fixing recesses can also be provided in the climbing rail, for example, in the form of teeth or holes.

If a latching/snap element fixed in or on the climbing rail is designed in the form of the fixing latch for meshing with at least one fixing recess in the climbing lift rail, the result is a simple, low-maintenance and reliable embodiment of the fixing means.

The fixing latch can be rotatably connected to the climbing rail and, in the connected state, be arranged on the climbing rail such that a fixing lug of the fixing latch, for example, due to gravity, a spring force, an electrostatic force, a magnetic force and/or an electromagnetic force, can mesh with the at least one fixing recess for fixing the climbing lift rail with respect to the climbing rail, i.e., for fixing the climbing lift rail to the climbing rail, when the fixing recess is at the level of the fixing lug. In one embodiment, the climbing lift rail, by using gravity, spring force and/or magnetic force, can be automatically fixed or locked relative to the climbing rail without introducing additional energy, for example, from an external power source or a hydraulic unit.

The fixing latch can be rotatably connected to the climbing rail such that the fixing lug of the fixing latch bears against an end face of the climbing lift rail facing the fixing lug when the fixing recess is located above or below, i.e., not at the level of, the fixing lug. This ensures that the fixing lug of the climbing rail can mesh with the fixing recess of the climbing lift rail when the fixing recess is located at the level of the fixing lug. The positioning of the fixing lug on the end face of the climbing lift rail facing the fixing lug can be done manually or by motor.

If an elongated hole is provided in the fixing latch, which, when the climbing lift rail is in a state fixed to the fixing means, has a vertical orientation with respect to the climbing rail, a pin, for example, in the form of a screw, fixed to the climbing rail can run through the elongated hole such that the fixing latch is translationally and/or rotatorily coupled to the climbing rail. This results in a very simple and yet fully functional coupling of the fixing latch to the climbing rail.

In one embodiment of the invention, a stop fixed to the climbing rail is arranged in the fixed state above the fixing lug between the fixing latch and the climbing lift rail such that, when an underside of the fixing lug is placed on a fixing underside facing the underside of the fixing recess in mesh with the fixing latch, the fixing latch is canted with respect to a stop underside of the stop and the fixing underside of the fixing recess facing the underside. This results in a fixing means with a reliable fixation or locking of the climbing rail relative to the climbing rail.

In a state of the climbing lift rail not fixed to the fixing means with respect to the climbing rail, in which the fixing lug protrudes from an end face of the climbing lift rail facing the fixing lug, a contact element on the climbing rail can be provided below the pin such that, when the fixing latch is positioned with the pin in an upper region of the elongated hole, the fixing latch bears against the contact element in order to protrude from the end face of the climbing lift rail facing the fixing lug. In this open position, the fixing latch can remain in a defined manner before, in the applied position, the fixing lug of the fixing latch bears against an end face of the climbing lift rail facing the fixing lug.

A fixing flange which is fixed to the climbing rail and comprises the pin and/or the stop and/or the contact element can advantageously be arranged between the fixing latch and the climbing rail. In this way, a climbing rail can be expanded by and retrofitted with the fixing means in a simple and cost-effective manner without the fixing means which is independent with respect to the lifting device and independent of a fixation of the lifting device. The fixing flange and the pin and/or the stop and/or the contact element can be integral with or connected to each other.

If the greatest distance between fixing recesses arranged one behind the other in a longitudinal direction of the climbing lift rail corresponds at most to a maximum stroke length of the lifting device, the fixing can be carried out over part of the maximum stroke length or at the maximum stroke length, i.e., at the fully extended lifting device, independently of a fixation by the lifting device. A fixation of the climbing lift rail according to the invention to the climbing rail is therefore possible in all operating states of the lifting device with regard to its stroke length and its lifting force.

A distance between adjacent fixing recesses can essentially correspond to a distance between adjacent retaining elements, introduced into the climbing lift rail one behind the other in a/the longitudinal direction of the climbing lift rail, in the form of retaining recesses or retaining knobs attached to the climbing lift rail for meshing with at least one latching/snap element of the climbing shoe. This simplifies the production of such a climbing lift rail.

The invention also comprises a rail-guided climbing system which comprises the assembly according to the invention consisting of a climbing rail and a climbing lift rail, wherein an overall length of the at least one climbing rail is sufficient to guide the climbing rail of at least two climbing shoes that are spaced apart from each other at a predetermined distance, for example, one floor height. The climbing system can be held by one of the at least two climbing shoes and the climbing shoes can be arranged in the climbing direction such that the climbing shoe, on which the climbing rail was suspended before the climbing lift rail was suspended by extending the lifting device, is anchored in a not yet fully hardened concrete and the climbing shoe, on which the climbing lift rail is suspended at a fixation independent from a fixation by the lifting device, is arranged in a previously completed concreting portion with fully hardened concrete. The climbing system can comprise a frame unit and/or a protective wall into which the at least one climbing rail is integrated or to which the at least one climbing rail is attached.

A method for constructing a rail-guided climbing system, which can be used in particular as a climbing formwork, a climbing frame, a climbing protection wall, and/or a climbing working platform, comprises the following steps according to the invention:

providing a climbing rail and a climbing lift rail such that the climbing lift rail can be moved relative to the climbing rail and is guided by the climbing rail, arranging climbing shoes on a building structure in a stationary manner, fixing a lifting device to the climbing rail at one end and to the climbing lift rail at the other end, guiding the climbing rail by the climbing shoes such that the climbing rail and the climbing lift rail are each suspended on at least one of the climbing shoes in the direction opposite the climbing direction and can be unhooked from the at least one climbing shoe in the climbing direction and moved relative to the at least one climbing shoe, and providing a fixing means such that the climbing rail and the climbing lift rail can be fixed to each other in a reversibly releasable manner independently of a fixation to each other by means of the lifting device.

The effects and advantages of this construction method according to the invention of a climbing system correspond to those of the above-described assembly of a climbing rail and a climbing lift rail according to the invention.

A method for climbing a rail-guided climbing system, which can be used in particular as a climbing formwork, a climbing frame, a climbing protection wall, and/or a climbing working platform, having the assembly consisting of a climbing rail and a climbing lift rail according to the invention is also part of the invention. The method comprises the following steps:

applying the fixing latch rotatably connected to the climbing rail on an end face of the climbing lift rail facing the fixing lug, wherein the fixing recess is located above or below, i.e., not at the level of, the fixing lug, extending the lifting device with the suspended climbing rail, wherein the climbing lift rail is moved against the climbing direction relative to the climbing rail until the climbing lift rail is suspended, continuing the extension movement of the lifting device, wherein a further movement of the climbing lift rail against the climbing direction is prevented by the completed suspension of the climbing lift rail, and the climbing rail is unhooked and moved relative to the climbing lift rail in the climbing direction until the fixing lug of the fixing latch meshes with the at least one fixing recess for fixing the climbing lift rail with respect to the climbing rail, wherein the fixing recess is located at the level of the fixing lug, and retracting the lifting device, wherein the climbing rail is moved against the climbing direction relative to the climbing lift rail until the fixing lug of the fixing latch, meshed with the at least one fixing recess, absorbs a load of the climbing system suspended on the climbing rail.

After applying the fixing latch, which is rotatably connected to the climbing rail, to an end face of the climbing lift rail facing the fixing lug, the climbing lift rail is thus suspended on at least one climbing shoe. The lifting device is then extended in order suspend the climbing rail, which leads to the climbing rail being unhooked. Then, the climbing lift rail is fixed in a reversibly releasable manner, and independently of a fixation by the lifting device, to the climbing rail by the fixing lug of the fixing latch meshing with the at least one fixing recess in order to fix the climbing lift rail with respect to the climbing rail. By retracting the lifting device, the vertical load of the climbing system is diverted via the climbing rail, the fixing latch, the fixing recess, the climbing lift rail and the climbing shoe into the concreting portion in which the climbing shoe is anchored. The formwork process can then begin immediately.

The climbing shoe on which the climbing rail was suspended before the climbing lift rail was suspended by extending the lifting device, whereby the climbing rail was unhooked, can be located further in the climbing direction than the climbing shoe on which the climbing lift rail is suspended when the lifting device is extended. The climbing shoe, on which the climbing rail was suspended before the climbing lift rail was suspended by the extension of the lifting device, can be anchored in concrete that has not yet fully hardened, and the climbing shoe, on which the climbing lift rail is suspended at a fixation to the climbing rail independent from a fixation by the lifting device, can be arranged in a previously completed concreting portion with fully hardened concrete. The next concreting portion to be completed can be shuttered with the climbing system immediately after climbing over the last completed, not fully hardened concreting portion, which is indicated by the suspension of the climbing rail on the climbing shoe of this concreting portion, because, during shuttering, the vertical load of the climbing system is not diverted into this climbing shoe, but into the next climbing shoe which is arranged relative to this climbing shoe against the climbing direction and anchored in an already fully hardened concreting portion.

In a further method for climbing a rail-guided climbing system which can be used in particular as a climbing formwork, a climbing frame, a climbing protection wall, and/or a climbing working platform and having the assembly according to the invention consisting of a climbing rail and a climbing lift rail, the following steps are carried out:

extending the lifting device with the suspended climbing rail, wherein the climbing lift rail is moved against the climbing direction relative to the climbing rail until the climbing lift rail is suspended, continuing the extension movement of the lifting device, wherein a further movement of the climbing lift rail against the climbing direction is prevented by the completed suspension of the climbing lift rail, and the climbing rail is unhooked and moved relative to the climbing lift rail in the climbing direction, for example, by at least one suspension distance of the climbing rail and additionally by a climbing shoe travel path, retracting the lifting device, wherein the climbing rail is moved against the climbing direction relative to the climbing lift rail until the climbing rail is suspended offset in the climbing direction, for example, by at least one suspension distance, continuing the retraction movement of the lifting device, wherein a further movement of the climbing rail against the climbing direction is prevented by the completed suspension of the climbing rail, and the climbing lift rail is unhooked and moved relative to the climbing rail in the climbing direction, for example, by at least the one suspension distance of the climbing rail, applying the fixing latch rotatably connected to the climbing rail on an end face of the climbing lift rail facing the fixing lug, wherein the fixing recess is located above or below, i.e., not at the level of, the fixing lug, extending the lifting device, wherein a further movement of the climbing lift rail against the climbing direction is prevented after a completed suspension of the climbing lift rail, and the climbing rail is unhooked and moved relative to the climbing lift rail in the climbing direction until the fixing lug of the fixing latch, for example, due to gravity, meshes with the at least one fixing recess for fixing the climbing lift rail with respect to the climbing rail, wherein the fixing recess is located at the level of the fixing lug, and retracting the lifting device, wherein the climbing rail is moved against the climbing direction relative to the climbing lift rail until the fixing lug of the fixing latch, which meshes with the at least one fixing recess, absorbs a load of the climbing system suspended on the climbing rail.

This method results in the same advantages and effects as the method described above, wherein, prior to fixing the climbing rail to the climbing lift rail independently of the lifting device and independently with respect to the lifting device, the climbing rail is moved in the climbing direction, for example, by at least one suspension distance of the climbing rail.

The method steps according to the invention are preferably defined as a cycle and go through the cycle until the frame unit and/or the protective wall has reached a further or several further floors of the building structure or a concreting portion of the building structure to be concreted.

BRIEF DESCRIPTION OF THE FIGURES

Further features and advantages of the invention are provided in the following detailed description of an embodiment of the invention, the claims and the figures of the drawings, which show details that are essential to the invention. The features shown in the drawings are depicted such that the special features, according to the invention, can be illustrated in great detail. The various features can each be implemented individually or collectively in any combination in variants of the invention. In the figures, the same reference signs denote the same or corresponding elements, in which:

DETAILED DESCRIPTION

Figure 1A:
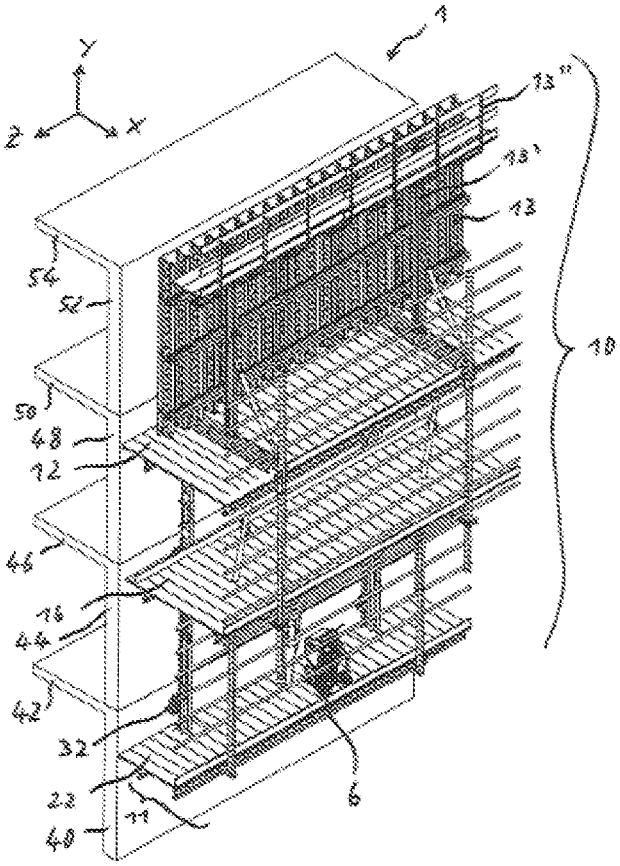
FIG. 1*a, b* is a three-dimensional external view of a rail-guided climbing system having an assembly consisting of a climbing rail and a climbing lift rail according to the invention (a) and a plan view of a climbing shoe comprised by the rail-guided climbing system with a climbing rail and a climbing lift rail in cross section (b)

FIG. 1 is a three-dimensional external view of a rail-guided climbing system 10 having a frame unit 11 for climbing on a building structure 1. The building structure 1 comprises a plurality of floors with outer walls 40, 44, 48, 52, wherein the floors comprise floor slabs 42, 46, 50, and 54 and are arranged one above the other in the Y direction, which corresponds to a climbing direction of the climbing system 10. On the outer walls 40, 44, 48, 52 of the building structure 1, climbing shoes, for example, the climbing shoe 32, are fastened one above the other in the Y direction and next to each other in the Z direction for each outer wall. The frame unit 11 of the climbing system 10 is suspended on at least one climbing shoe via an assembly consisting of a climbing rail and a climbing lift rail, both of which are aligned in the Y direction, and can be moved in the Y direction and in the negative Y direction. The assembly occurs twice in the climbing system 10 such that both assemblies lie next to each other and parallel to each other in the Z direction and the frame unit 11 is suspended on at least one climbing shoe per assembly consisting of a climbing rail and a climbing lift rail.

The frame unit 11 comprises a formwork platform 12 having a formwork 13, which can be moved together in the horizontal direction, i.e., the X direction and/or the negative X direction, towards the building structure 1 and/or away from the building structure 1, in order to complete a concreting portion, for example, of a floor of the building structure 1. The formwork 13 is fastened to horizontal beams which in turn are fastened to vertical beams 13' of the formwork 13. A railing 13" is attached to the vertical beams 13' as part of the formwork platform 12 in order to be able to fill liquid concrete in the negative X direction behind the formwork 13 to complete the concrete portion to be concreted and thereby be secured against falling from the formwork platform 12.

A working platform 16, which is fixed to the formwork platform 12, is arranged below the formwork platform 12. A control unit for operating a drive for moving the formwork and/or a lifting device 26 for climbing the climbing system 10 can be arranged on the working platform. The lifting device 26 is located on a trailing platform 22 which is arranged below the working platform 16 and fixed to the working platform 16. In the climbing system 10 shown in FIG. 1, the frame unit 11 thus comprises the formwork platform 12, the working platform 16, and the trailing platform 22, wherein a climbing rail, which can be suspended on the climbing shoes against the climbing direction and unhooked from the climbing shoes in the climbing direction, is integrated in the frame unit 11 or fastened to the frame unit 11. The trailing platform 22 is used, among other things, for attaching and removing the climbing shoes, for example, the climbing shoe 32, which are arranged on the building structure 1 in a stationary manner and used to guide and support the climbing rail that carries the frame unit 11. In FIG. 1*a*, two climbing rails, aligned parallel to each other in the Z direction and each running in the Y direction, are arranged on the frame unit 11.

Figure 1B:
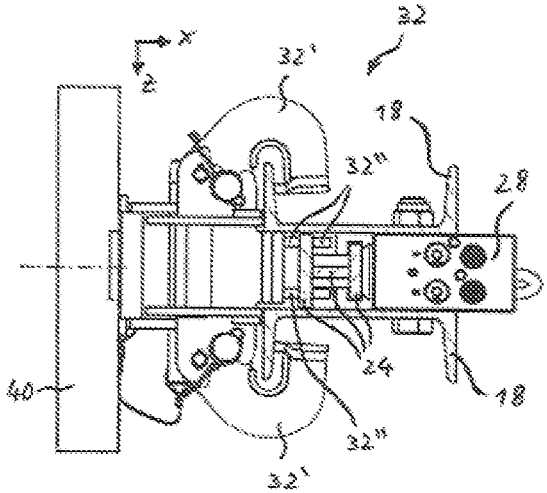

FIG. 1*b* shows the climbing shoe 32 fastened to the outer wall 40 in cross section in the X/Z plane together with a climbing rail 18 and a climbing lift rail 24. The climbing shoe 32 is inserted into a recess in the outer wall 40 in the negative X direction and fastened to the outer wall 40. The climbing shoe 32 has limbs 32' opposite from and facing each other in the Z direction for meshing with the climbing rail 18 and a climbing latch 32" for meshing with the climbing lift rail 24. The climbing lift rail 24 has an I-shaped cross section, also called a double T-shaped cross section. The climbing lift rail 24 is arranged in the climbing rail 18 between two U-shaped elements of the climbing rail 18, wherein the side of the climbing lift rail 24 facing the outer wall 40 can mesh with the climbing latch 32", which can be seen in FIG. 1*b*, because in addition to the cross section of the climbing rail 18 and the climbing lift rail 24, a plan view of the climbing shoe 32 is shown.

The climbing latch 32" has two lugs which are arranged parallel to each other and which can mesh with the side of the climbing lift rail 24 facing the outer wall 40. In addition, the climbing shoe 32 has the two limbs 32', the lugs of which can bear against the portions of the climbing rail 18 facing the outer wall 40. The limbs 32" are each pivotable about the vertical axis, which runs in the Y direction, and can be fixed in their position with locking pins. Other limbs that are not pivotable and/or can be used without a locking pin are possible. The climbing latch 32" can mesh with both the climbing lift rail 24 and the climbing rail 18 in order to enable both the climbing lift rail 24 and the climbing rail 18 to be suspended on the climbing shoe 32. However, designs of climbing shoes, in which different climbing latches are present in order to be able to suspend and unhook either the climbing rail 18 or the climbing lift rail 24 are also conceivable.

The top view of FIG. 1*b* shows an upper end 28 of a lifting device 26, which is arranged between the two U-shaped elements of the climbing rail 18 and connected to these elements and thus to the climbing rail 18, for example, via the screw connection oriented in the Z direction and shown in FIG. 1*b*. The climbing rail 18 is guided by the climbing shoe 32, wherein the climbing rail 18 and the climbing lift rail 24 can each be suspended on at least the climbing shoe 32 in the direction opposite the climbing direction, i.e., in the negative Y direction, and unhooked from the climbing shoe 32 in the climbing direction, i.e., in the Y direction, and designed to be movable with respect to said climbing shoe.

Figure 2A:
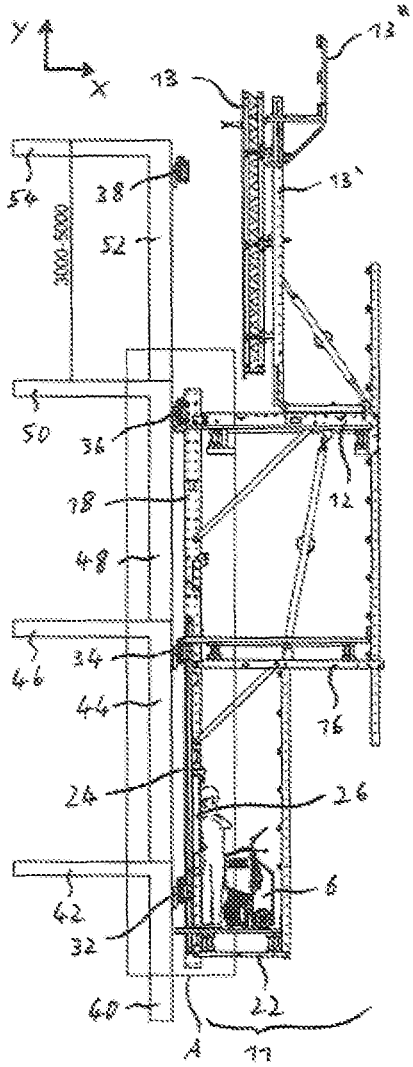
FIG. 2*a-c* is a side view of the rail-guided climbing system shown in FIG. 1*a* (a), a section of the side view (b), and a spatial external view of the section (c)

FIG. 2*a* is a side view of the climbing system 10 shown in FIG. 1*a*. The frame unit 11 of the climbing system 10 is attached to the climbing rail 18 with the formwork platform 12, the working platform 16 and the trailing platform 22. It is also possible for the platforms 12, 16 and 22 and the climbing rail 18 to be an integral part of the frame unit 11. The climbing rail 18 is guided by climbing shoes 32, 34 and 36 and is always suspended on at least one of the climbing shoes 32, 34, 36. The climbing shoe 38 in the outer wall 52 with the floor slab 54 extending in the negative X direction is used to guide and suspend the rail 18 when the next outer wall in the Y direction above the outer wall 52 is supposed to be concreted. Since the outer wall 52 with the floor slab 54 is concreted last, a load capacity of the outer wall 52, due to the suspension of the climbing system 10 on the climbing shoe 38, is lower than a load capacity of the outer wall 48 which is arranged in the negative Y direction below the outer wall 52 and was concreted earlier than the outer wall 52. It is therefore possible that the frame unit 11, the vertical load of which is diverted into the building structure 1 by the climbing rail 18, may not be suspended on the climbing shoe 38 of the outer wall 52 as long as the concrete present in this outer wall has not hardened sufficiently. Instead, the climbing system 10 should be suspended on at least one of the climbing shoes 32, 34 and/or 36 because the outer walls 40, 44 and 48 with the floor slabs 42, 46 and 50 are already sufficiently hardened in order to be able to support the climbing system 10. The climbing lift rail 24 at the level of the climbing shoe 32 and the climbing shoe 34 is movable relative to the climbing rail 18 and guided by the climbing rail 18, wherein the climbing lift rail 24, similar to the climbing rail 18, can be suspended on each of the climbing shoes 32, 34, 36, 38 in the direction opposite the climbing direction, i.e., in the negative Y-direction, and unhooked from each of the climbing shoes 32, 34, 36, 38 in the climbing direction, i.e., in the positive Y direction, and is movable with respect to each of these climbing shoes.

The climbing system 10 further comprises the lifting device 26 that is fixed at one end to the climbing rail 18 with its upper end 28 in the Y direction and at the other end to the climbing lift rail 24 with a lower end in the negative Y direction of the lifting device 26. The climbing rail 18 and the climbing lift rail 24 are therefore fixed to each other by the lifting device 26 and can be moved relative to each other by means of the lifting device 26 in order to effect a climbing movement in the Y direction. The hydraulic unit 6 is arranged on the trailing platform in order to supply the lifting device 26 with energy for operating the lifting device 26. As already described, the hydraulic unit 6 can also be used to move the formwork 13 which is attached to the vertical beams 13' for moving in the negative X direction and/or in the X direction. The railing 13" attached to the vertical beams 13' is used to secure a worker who fills a hollow space, shuttered by the formwork 13, of a concreting portion to be concreted, for example, an outer wall of the building structure 1 to be concreted next, with concrete.

Figure 2B:
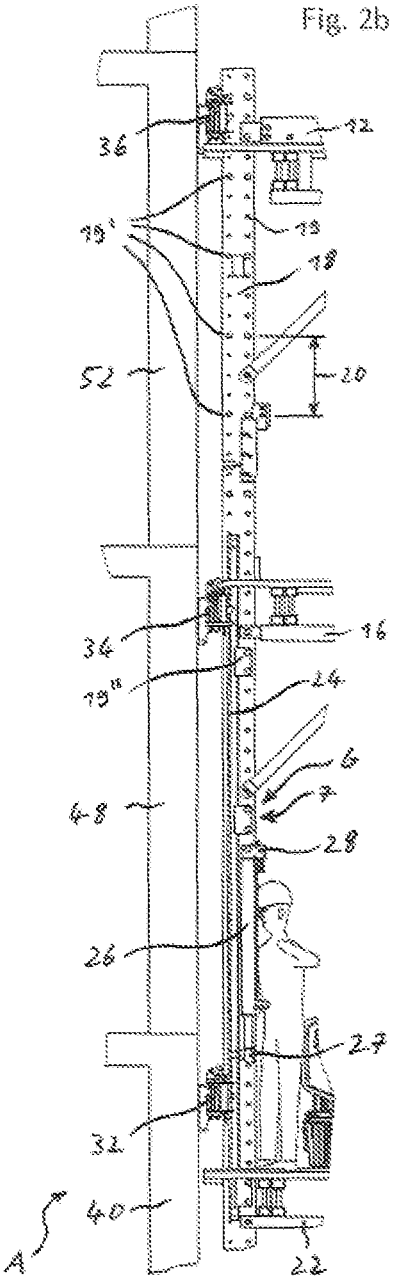

FIG. 2*b* shows an enlarged section A from FIG. 2*a*. The climbing rail 18 has support bolts 19' in the Y-direction, which are each suspended on one of the climbing shoes 32, 34, 36 and can be unhooked from each of these climbing shoes, wherein three bores 19 are arranged in the climbing rail 19 between adjacent support bolts 19' of the climbing rail 18. The support bolts 19' are spaced apart from each other by a suspension distance 20 in the Y direction, wherein the lifting device 26 has a stroke which is able to traverse the suspension distance 20 and also one climbing shoe travel path in order to be able to suspend the climbing rail offset by a suspension distance 20 on one the climbing shoes 32, 34, 36. The climbing lift rail 24 is movable relative to the climbing rail 18 and guided by the climbing rail 18 by means of at least one guide shoe 19" or another type of guide. In addition, the climbing lift rail 24, for example, in an end portion of the climbing lift rail in the negative Y direction, is connected to the climbing rail 18 via the lower end 27 of the lifting device 26 with the upper end 28 of the lifting device 26, for example, via a piston and a lifting cylinder.

In addition, a fixing means 7 is provided in order to fix the climbing rail 18 and the climbing lift rail 24 to each other in a reversibly releasable manner independently of a fixation to each other by means of the lifting device 26. The fixing means 7 is in a closed position such that the climbing rail 18 is fixed to the climbing lift rail 24 in a reversibly releasable manner. The fixation of the two rails to each other is independent of any further fixation of the two rails to each other by the lifting device 26. In this respect, the fixing means 7 is able to independently fix the climbing rail 18 and the climbing lift rail 24 to each other, i.e., as if the lifting device 26 were not present.

Figure 2C:
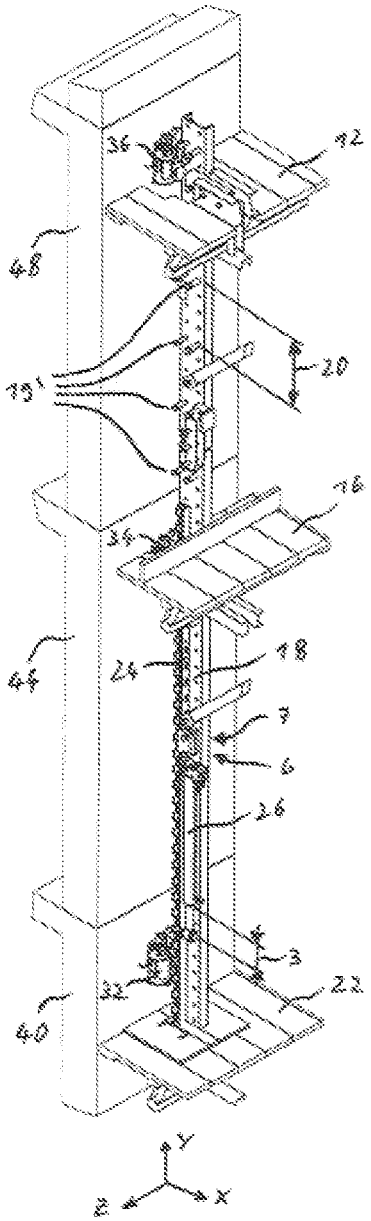

In FIG. 2*c*, the section A shown in FIG. 2*b* is shown in a three-dimensional external view. The support bolts 19', which are spaced apart from each other in the Y direction by the suspension distance 20 of the climbing rail 18, allow for the climbing rail 18 to be suspended on each of the climbing shoes 32, 34, 36, wherein the lifting device 26 has a stroke length 3 in order to traverse the suspension distance 20 and also the climbing shoe travel path when the climbing rail is supposed to be suspended on one of the climbing shoes 32, 34, 36 offset by the suspension distance 20 in the Y direction. The climbing shoe travel path must be traversed in the Y direction by the support bolt 19' level with one of the climbing shoes 32, 34, 36, i.e., horizontally in the X direction, in order to achieve a subsequent suspension of the climbing rail 18 with a movement in the negative Y direction. Traversing the climbing shoe travel path therefore puts the climbing shoe into an operating state in which the climbing rail 18 can be suspended during a movement in the direction opposite the climbing direction, i.e., the negative Y-direction, after this movement has been completed.

The climbing lift rail 24 is movably guided on the climbing rail 18, and the climbing lift rail 24 is fixed to the climbing rail 18 via the lifting device 26. In addition, the fixing means 7, which is arranged, for example, above the lifting device 26 in the Y direction, is provided in order to fix the climbing rail 18 and the climbing lift rail 24 to each other in a reversible manner independently of the fixation to each other by the lifting device. The fixing means 7 is in the closed position G such that, regardless of an operating state of the lifting device 26, the climbing lift rail 24 is fixed to the climbing rail 18. If the climbing system 10 is attached to the outer wall of the building structure 1 via the climbing rail 18 and the climbing lift rail 24 by introducing a vertical load of the climbing system 10 into at least one of the climbing shoes 32, 34, 36, the lifting device 26 can be put out of operation or switched off in order to avoid a compressive and/or tensile load on the lifting device 26 and to save energy from the hydraulic unit 6 for supplying the lifting device 26 when the climbing system 10 is connected to one of the climbing shoes 32, 34, 36 via the climbing lift rail 24 for introducing the vertical load of the climbing system 10 into the building structure 1.

Figure 3A:
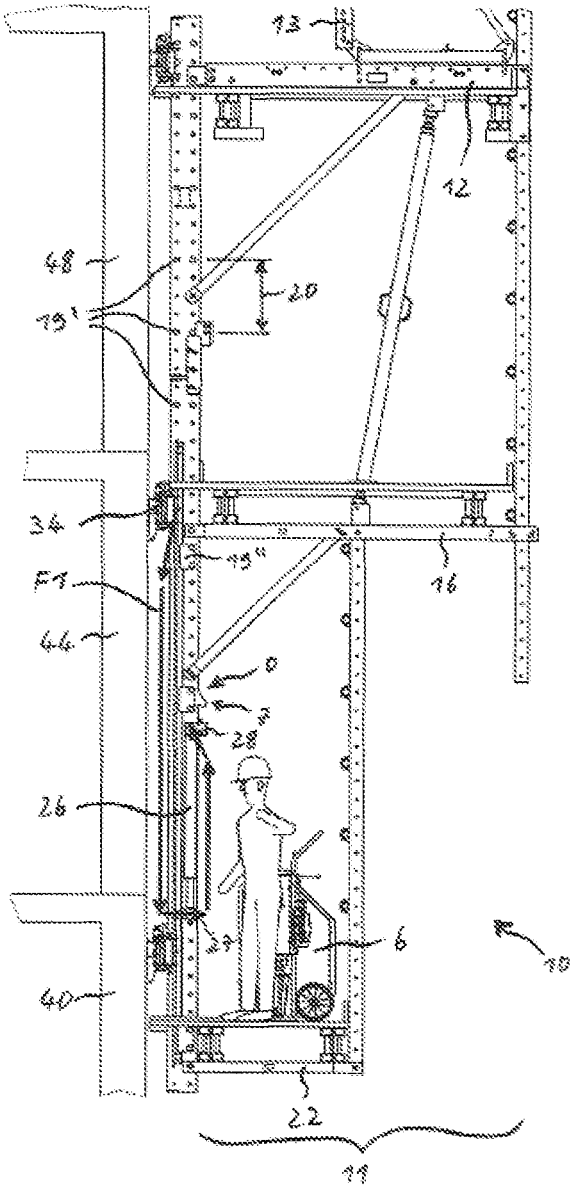
FIG. 3*a, b* is a side view of the rail-guided climbing system shown in FIG. 2*a* having the assembly consisting of the climbing rail and the climbing lift rail and a fixing means according to the invention in the open position (a) and a spatial external view of the assembly consisting of the climbing rail and the climbing lift rail with the fixing means in the open position (b)

FIG. 3*a* is a side view of the rail-guided climbing system 10 shown in FIG. 2*a* having the assembly consisting of the climbing rail 18 and the climbing lift rail 24 and the fixing means 7 in an open position O. The frame unit 11 of the climbing system 10 is fastened to the building structure 1 such that the climbing lift rail 24 is suspended on the climbing shoe 34 in an upper portion of the climbing lift rail in the Y direction. The frame unit 10, which is attached to the climbing rail 18 or integral with the climbing rail 18, is not fixed to the climbing lift rail 24 via the fixation 7 because the fixation 7 is in the open position O in which there is no fixation of the climbing rail to the climbing rail. Instead, the vertical load of the frame unit 10 acting on the climbing shoe 34 and introduced into this climbing shoe is guided via the climbing lift rail 24, for example, from an upper portion of the climbing lift rail in the Y direction to a lower portion of the climbing lift rail in the negative Y direction, to the lower end 27 of the lifting device 7, as shown by the arrow F1. From the lower end 27 of the lifting device 26, the vertical load of the frame unit 11 is guided to the upper end 28 of the lifting device 26, which is connected to the climbing rail 18. At the location of the upper end 28 of the lifting device, the vertical load of the frame unit 11 of the climbing system 10 is diverted into the lifting device 26, then into its lower end 27 and from there via a lower portion of the climbing lift rail 24 to an upper portion of the climbing lift rail 24 and from there into the climbing shoe 34 and from there into the building structure 1.

Figure 3B:
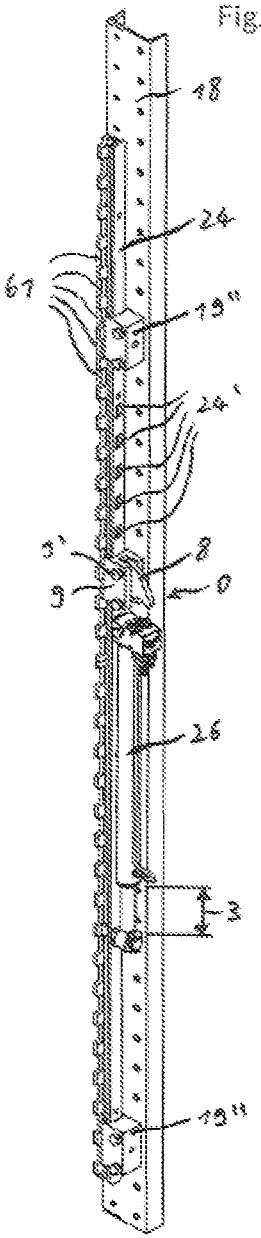

FIG. 3*b* is an enlarged three-dimensional external view of the assembly consisting of the climbing rail 18 and the climbing lift rail 24 with the fixing means 7 in the open position O. The climbing lift rail 24 is guided on the climbing rail 18 by means of two guide shoes 19", wherein the first guide shoe 19" is located in an upper portion of the climbing lift rail 24 and the second guide shoe 19" is arranged in a lower portion of the climbing lift rail 24. The lifting device 26 is extended by the stroke length 3, wherein a further extension of the lifting device in the Y direction results in the climbing lift rail 24 being lifted out of the guide by the guide shoe 19" at the lower end portion of the climbing lift rail 24 in the Y direction. The climbing lift rail 24 has fixing recesses 24' which each can mesh with a fixing latch 8 of the fixing means 7. At a given point in time, when the fixing latch 8 is at the level of one of the fixing recesses 24', i.e., horizontal in the Y direction, the fixing latch can mesh with the fixing recess 24' at the level of the fixing latch 8. The fixing latch is not latched into any of the fixing recesses 24', so that the fixing means 7 is in the open position O. In addition to the fixing recesses 24' for meshing with the fixing latch 8 of the fixing means 7, retaining recesses 61 are provided on the climbing lift rail, which are used to suspend the climbing lift rail 24 on one of the climbing shoes 32, 34, 36. Both the fixing recesses 24' and the retaining recesses 61 are spaced apart from each other at essentially the same distances and aligned in the climbing direction, i.e., in the Y direction. The fixing latch 8 is rotatably mounted on a fixing flange 9 about an axis of rotation 9' which can be formed, for example, by a screw of a screw connection and is oriented in the Z direction. The fixing latch 8 is therefore rotatably connected via the axis of rotation 9' to the fixing flange 9 which is fixed to the climbing rail 18, for example, by using a further screw connection through the bore 19 in the climbing rail 18. A distance between mutually adjacent retaining recesses 61 can correspond to a distance between mutually adjacent fixing recesses 24'. Different distances between adjacent retaining recesses 61 with respect to a distance between adjacent fixing recesses 24' are possible.

Figure 4A:
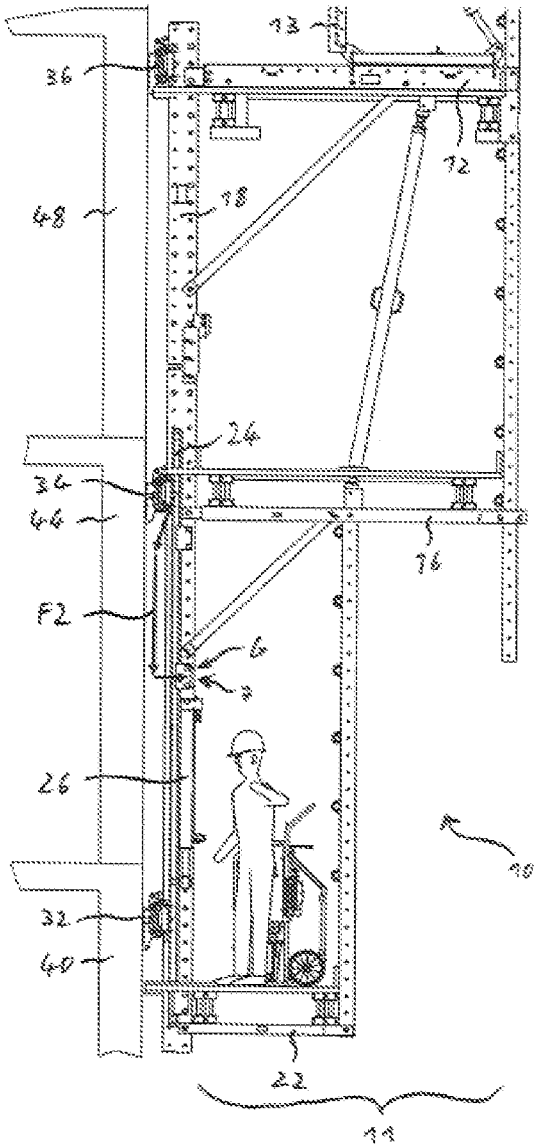
FIG. 4*a, b* is a side view of the rail-guided climbing system shown in FIG. 2*a* having the assembly consisting of the climbing rail and the climbing lift rail and a fixing means according to the invention in the closed position (a) and a spatial external view of the assembly consisting of the climbing rail and the climbing lift rail with the fixing means in the closed position (b)

FIG. 4*a* is a side view of the rail-guided climbing system 10 shown in FIG. 2*a* having the assembly consisting of the climbing rail 18 and the climbing lift rail 24 and the fixing means 7 in the closed position G. In contrast to the state of the fixing means 7 as shown in FIG. 3*a*, the fixing means 7 is closed in a reversibly releasable manner such that the climbing lift rail 24 is fixed to the climbing rail 18 and therefore not movable relative to the climbing rail 18 in the climbing direction and in the direction opposite the climbing direction. The vertical load of the frame unit 11 of the climbing system 10, which is diverted via the climbing shoe 34 into the outer wall 44 of the building structure 1, is guided from an upper portion of the climbing lift rail 24 in the Y direction, via which the climbing lift rail 24 is connected to the climbing shoe 34 and suspended on the climbing shoe 34, approximately to a central portion of the climbing lift rail 24, where a fixing recess 24' is present, which meshes with the fixing latch 8 of the fixing means 7. The vertical load is therefore introduced from the fixing recess 24' into the fixing latch 8 of the fixing means 7 and from there via the axis of rotation 9' into the fixing flange 9 which is fixed to the climbing rail 18. The vertical load of the frame unit 11 of the climbing system 10 bearing against the climbing rail 18 is therefore guided to the fixing flange 9 and from there via the axis of rotation 9' to the fixing latch 8 and from there to the fixing recess 24' in the climbing lift rail 24 and from there to the one retaining recess 61 guided in the climbing lift rail 24, which is suspended on the climbing shoe 34, in order to divert the vertical load via the climbing shoe 34 into the outer wall 44 of the building structure 1. The fixing of the climbing rail to the climbing lift rail allows for the lifting device 26, which is connected to both the climbing lift rail 24 and the climbing rail 18, to be switched off and does not allow the vertical load of the frame unit 11 to be diverted from the climbing rail into the climbing lift rail when it is in the switched-off state. Instead, the fixing means 7 in the closed position G assumes the fixing of the climbing lift rail and the climbing rail to each other, so that the lifting device 26 can be switched off, is not subjected to tension and/or pressure, and the hydraulic unit 6 does not have to provide any energy to maintain the operation of the lifting device 26.

Figure 4B:
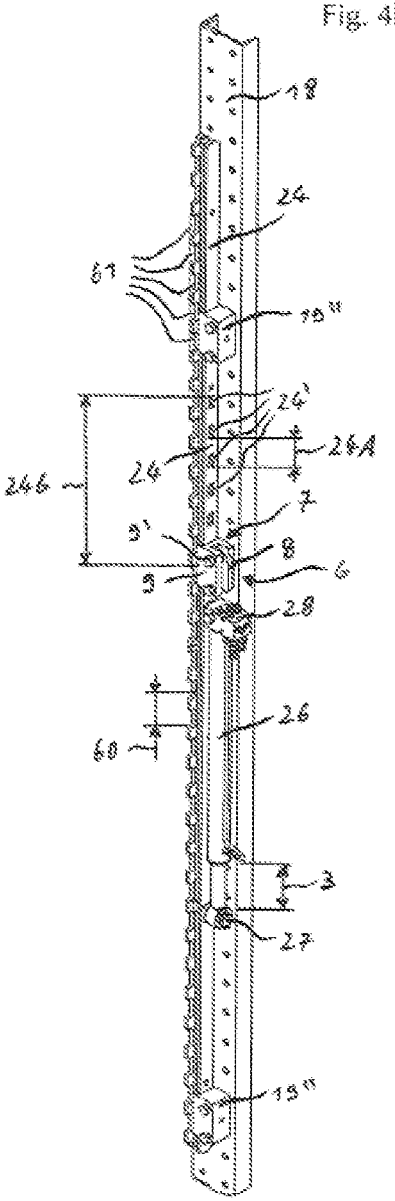

FIG. 4*b* is an enlarged three-dimensional external view of the assembly consisting of the climbing rail 18, the climbing lift rail 24 and the fixing means 7 according to FIG. 4*a*. According to the state of the climbing lift rail 24 shown in FIG. 3*b*, the climbing lift rail 24 is guided by two guide shoes 19" and fixed to the climbing rail 18 via one of the fixing recesses 24' and a fixing latch 8 of the fixing means 7 meshing with the fixing recess 24'. The fixing latch 8 is rotatably mounted relative to the fixing flange 9 via the axis of rotation 9', which is connected to the climbing rail 18, for example, via the bore 9 and a screw connection in the Z direction. The fixing recesses 24' are present in the climbing lift rail 24 in the form of fully edged rectangular recesses or holes, also called ears, which, similar the retaining recesses 61, lie next to each other in the Y direction, i.e., in the climbing direction. A greatest distance 24G between fixing recesses 24' arranged one behind the other in a longitudinal direction of the climbing lift rail 24, which corresponds to the Y direction, corresponds to a maximum stroke length of the lifting device 26, which is greater than the stroke length 3 of the lifting device 26. The distance 60 between mutually adjacent retaining recesses 61 corresponds to the distance 24A between mutually adjacent fixing recesses 24'. Due to the fixing of the climbing lift rail 24 to the climbing rail 18 by means of the fixing means 7, which is in the closed position G and therefore closed or locked, a further or additional fixation of the two rails to each other by the lifting device 26 is not necessary. Instead, the lifting device 26 can be switched off and, without the possibility of diverting a vertical load bearing against the climbing rail 18 into the climbing lift rail 24 via the lifting device 26, can be connected to the climbing rail 18 only with the upper end 28 and to the climbing lift rail 24 with the lower end 27.

Figure 5A:
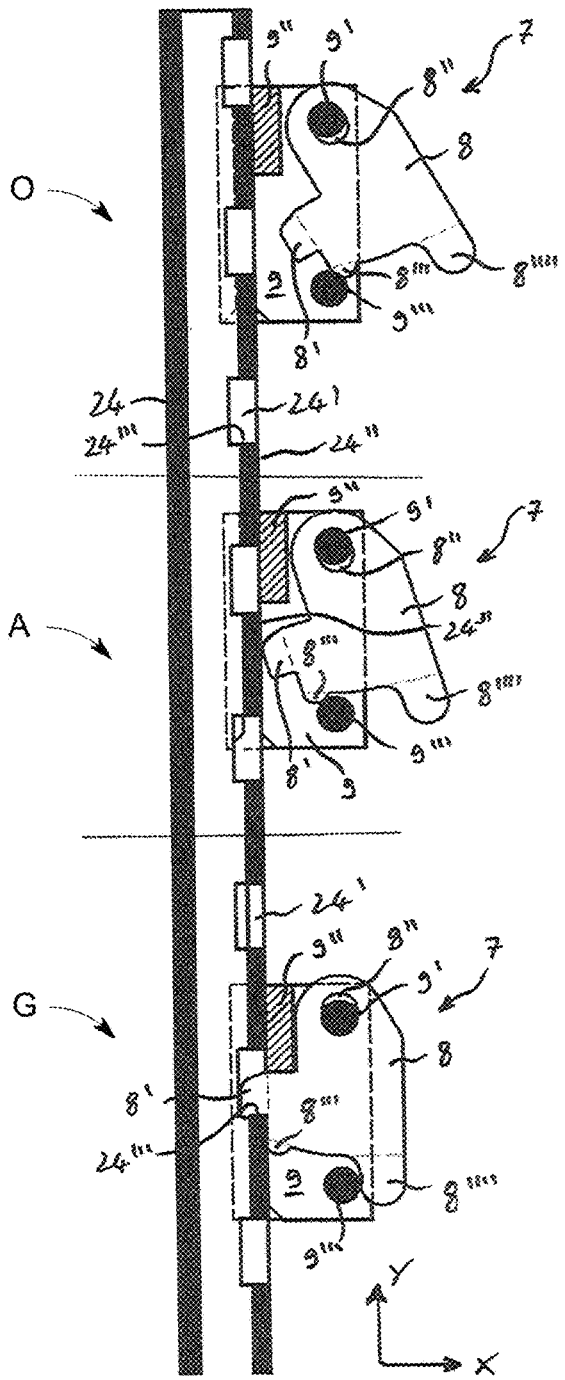
FIG. 5*a, b* shows a cross section of the climbing lift rail and the fixing means according to the invention in the open position, the applied position and the closed position in a side view (a) and in a spatial external view (b)

FIG. 5*a* is a side view of the same fixing means 7 shown in different operating states when viewed together with the climbing lift rail 24 in the open position O, the applied position A, and the closed position G. The climbing lift rail 24 having the fixing recesses 24' is therefore not to be regarded as a rail running continuously in the Y direction, but the same fixing means 7 is located on the same climbing lift rail 24, wherein the fixing means 7 in the X direction is located at different heights relative to the climbing lift rail 24. The fixing means 7 thus has the same elements in each of the three operating states, so that there is a plurality of fixing recesses 24' but, for example, only one fixing lug 8' is present, which in the closed position meshes with one of the fixing recesses 24'. This is illustrated by horizontal lines in the X direction, which separate the depicted operating states of the same fixing means 7 from each other. Correspondingly, the same fixing means 7 in the open position O, the applied position A, and the closed position G is shown spatially in cross section in FIG. 5*b*, wherein, as in FIG. 5*a*, the same fixing means 7 is shown in the different operating states on the same climbing lift rail 24 (see horizontal lines for delimiting the depicted operating states from each other).

Figure 5B:
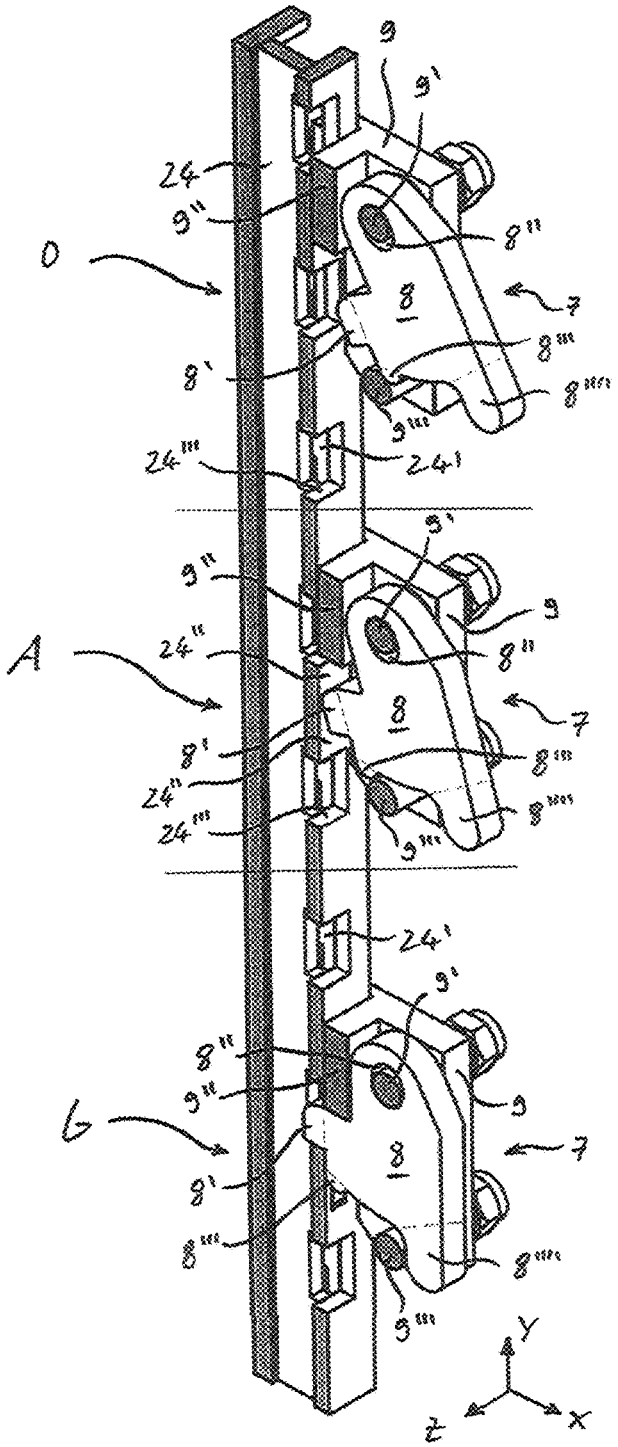

In the upper area of both FIGS. 5*a* and 5*b*, the fixing means 7 is shown in the open position O as the operating state. The fixing means 7 comprises the fixing latch 8 having a fixing lug 8', wherein the fixing latch 8 has an elongated hole 8" which, in a state of the climbing lift rail 24 fixed to the fixing means 7, i.e., in the closed position G, which is shown in the lower region of FIG. 5*a* and FIG. 5*b*, has a vertical alignment in the Y direction. Between the fixing latch 8 and the climbing rail 18 (not depicted), a fixing flange 9 is arranged, which is fixed to the climbing rail and comprises a pin 9' and a stop 9" as well as a contact element 9'". The pin 9' is designed in the form of a screw which runs through the elongated hole 8" and is fixed to the climbing rail such that the fixing latch 8 is coupled to the climbing rail 18 in a translational and rotatory manner via the fixing flange 9. In the open position O, i.e., the non-fixed state of the climbing lift rail 24 with respect to the climbing rail 18, the fixing lug 8' protrudes from an end face 24" of the climbing lift rail 24 facing the fixing lug 8', wherein, below the pin 9', i.e., in the negative Y-direction, the contact element 9'" is provided on the fixing flange 9, which in turn is attached to the climbing rail 18, such that when the fixing latch 8 is positioned with the pin 9' in an upper region of the elongated hole 8", the fixing latch 8 bears against the contact element 9'" in order to protrude from the end face 24" of the climbing lift rail 24 facing the fixing lug 8'. The fixing flange 9 which is fixed to the climbing rail 18 and comprises the pin 9', the stop 9" and the contact element 9'" is thus arranged between the fixing latch 8 and the climbing rail 18. In the open position O, a contact lug 8'" of the fixing latch 8 is arranged below the upper point of the contact element 9'" in the Y direction such that, without moving the fixing latch 8 in the Y direction, the open position O of the fixing means 7 cannot be transferred into the applied position A by moving the fixing latch 8 in the negative X direction.

In the middle region of each of FIGS. 5*a* and 5*b*, the fixing means 7, shown in the open position in the upper region of these figures, is shown in the applied position A. The fixing latch 8 is connected to the climbing rail 18 via the axis of rotation 9' in the embodiment of a screw connection such that the fixing lug 8' of the fixing latch 8 bears against the end face 24" of the climbing lift rail 24 facing the fixing lug 8' when the fixing recess 24' is located above or below the fixing lug 8', i.e., not at the level in the X direction, as is shown in the middle portion of FIGS. 5*a* and 5*b*. Even though the fixing lug 8' is at the level of the fixing recess 24' in the open position O, there is no contact of the fixing lug 8' with the climbing lift rail 24 because the contact element 9''' attached to the fixing flange 9 is arranged in relation to the fixing latch 8 such that a movement of the fixing lug 8' and thus the fixing latch 8 in the direction of the climbing lift rail 24 in the negative X direction is prevented due to gravity by the contact of the fixing latch 8 with the contact element 9'''. This is not the case in the applied position A because the fixing latch 8 was moved while guided in the Y direction through the elongated hole 8" and the axis of rotation 9' in order to lift the fixing latch 8 over the contact element 9" and to apply it in the negative X-direction to the end face 24" of the climbing lift rail 24 facing the fixing lug 8'. The contact lug 8''' of the fixing latch 8 lies in the applied position A below an upper point of the contact element 9''' in the Y direction such that the fixing latch 8 cannot leave the applied position to return to the open position without moving the fixing latch 8 in the Y direction.

In the lower region of each of FIGS. 5*a* and 5*b*, the fixing means 7, shown in the middle portion in the applied position A and in the upper portion in the open position O, is shown in the closed position G. The fixing latch 8 is rotatably connected to the climbing rail 18 via the fixing flange 9 and is arranged such that, due to gravity, the fixing lug 8' of the fixing latch 8 meshes with the fixing recess 24' for fixing the climbing lift rail 24 with respect to the climbing rail 18, wherein the fixing recess 24' is located at the level of the fixing lug 8', i.e., in the horizontal or in the X direction at the same level as the fixing latch 8'. In the fixed state of the climbing rail 18 relative to the climbing lift rail 24, i.e., in the closed position G as a further operating state of the fixing means 7, the stop 9" fixed to the climbing rail via the fixing flange 19 is arranged above the fixing lug 8', i.e., in the Y direction, between the fixing latch 8 and the climbing lift rail 24. The stop 9" is arranged such that, when an underside of the fixing lug 8' rests on a fixing underside 24''', which faces said underside, of the fixing recess 24' that meshes with the fixing latch 8, the fixing latch 8 is canted with respect to a stop underside of the stop 9" and the fixing underside 24''' of the fixing recess 24' facing the underside. In the closed position G, the contact lug 8''' of the fixing latch 8 no longer bears against the contact element 9''' but instead bears against the end face 24" of the climbing lift rail 24 facing the fixing lug 8'. The elongated hole 8" is aligned vertically, i.e., in the Y direction, and thus parallel to an alignment of the climbing lift rail 24, wherein a fixing latch tab 8'''' bears against a side of the contact element 9''' facing away from the climbing lift rail 24 at the lower end of the fixing latch 8 in the negative Y direction.

Since the fixing underside 24''' of the fixing recess 24' bears against the underside of the fixing lug 8', the fixing latch 8 and thus the climbing rail 18 cannot be moved in the negative Y direction with respect to the climbing lift rail 24, i.e., against the climbing direction. As long as a force acts on the fixing latch 8 in the negative Y-direction, i.e., in the direction opposite the climbing direction, for example, due to the vertical load bearing against the climbing rail 18, the fixing latch 8 and thus the climbing rail 18 and consequently the frame unit 11 cannot be moved in the direction opposite the climbing direction, i.e., in the negative Y direction, due to the contact of the underside of the fixing lug 8' on the fixing underside 24''' of the fixing recess 24'. When the fixing latch 8 is raised in the climbing direction, i.e., the Y direction, by lifting the climbing rail 18, for example, due to an extension movement of the lifting device 26, the fixing lug 8', together with the stop 9", can be moved in the climbing direction such that, when the fixing latch tab 8'''' is actuated in the X direction, the fixing latch 8 is rotated about the axis of rotation 9' such that the fixing latch 8 can be moved from the closed position G to the applied position A and/or to the open position O.

Both the contact element 9''' and the axis of rotation 9' are, as can be seen in the lower portion of FIG. 5*b*, each designed as screw connections with cylindrical screws. Since the fixing means 7 is shown in cross section in each of FIG. 5*a*, 5*b*, the fixing flange 9 does not have an L shape as shown in FIG. 5*b* but a U shape with a U open in the X direction, as shown, for example, in FIG. 4*b*. The screw connections of both the axis of rotation 9' and of the contact element 9''' are therefore each guided through bores in two opposite sides of the fixing flange 9 (see FIG. 4*b*). Since the fixing lug 8' automatically meshes with the fixing recess 24' due to gravity when the fixing recess 24' is located at the level of the fixing lug 8', i.e., at the same height in the X direction as the fixing lug 8', the fixing means 7 is a semi-automatically acting fixing device to be actuated manually. Other manual or fully automatic fixing means 7 are possible. The fixing means 7 shown in each of FIGS. 5*a* and 5*b* is designed to be mechanically simple, low-maintenance, produced cost-effectively and reliable such that it can be used efficiently for use in a climbing system. Due to the interaction of the fixing latch lug 8''' and the fixing latch tab 8'''' with the contact element 9''' with the guiding of the fixing latch 8 through the axis of rotation 9' and the elongated hole 8", defined operating states are achieved in the open position, the applied position, and the closed position due to gravity, which serves the operational safety of the fixing means 7.

Figure 6A:
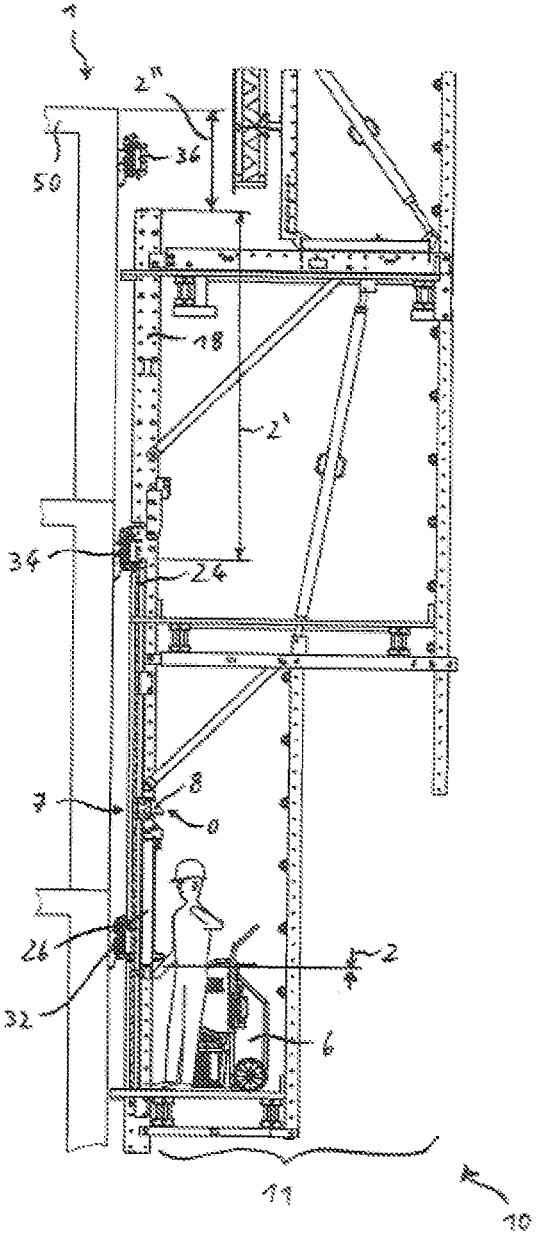
FIG. 6*a-k* shows a sequence of climbing processes with climbing states a to k of the climbing system shown in FIG. 1 with the fixing means according to the invention in the open position (a-f), the applied position (g-i) and the closed position (j, k) in a side view.
Figure 6B:
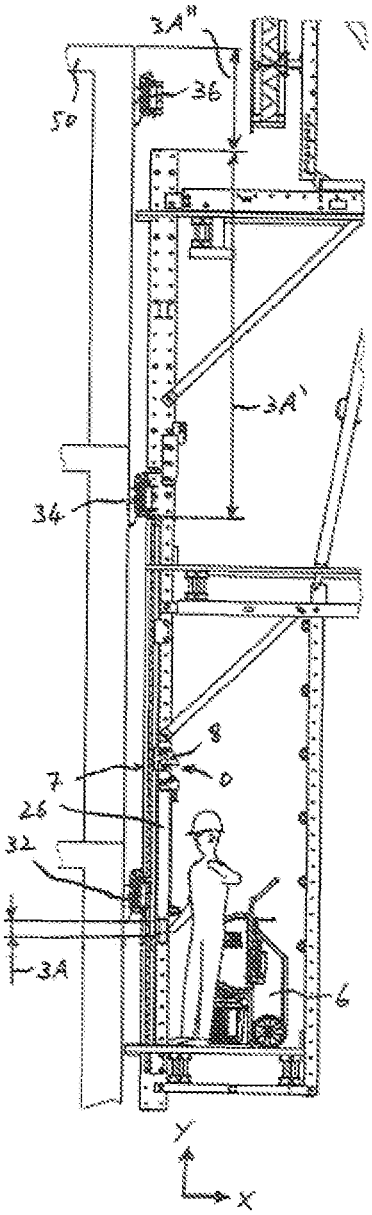
Figure 6C:
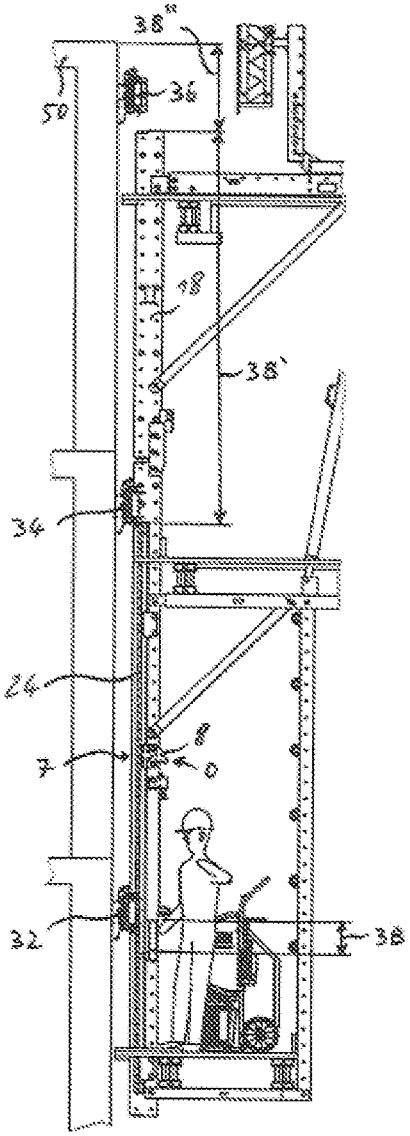
Figure 6D:
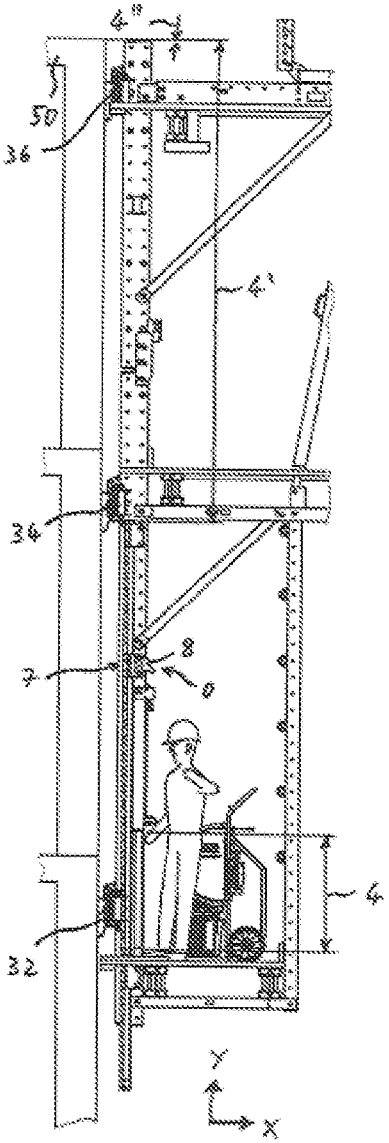
Figure 6E:
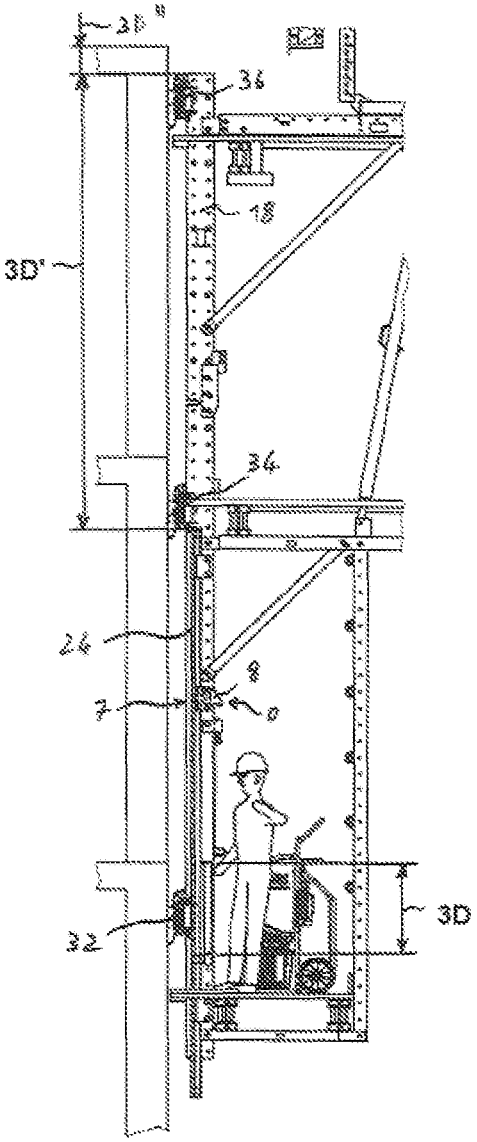
Figure 6F:
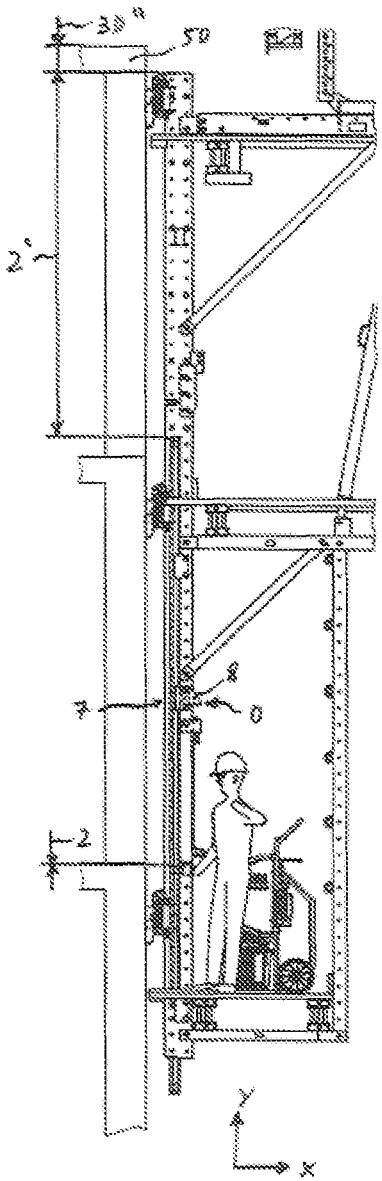
Figure 6G:
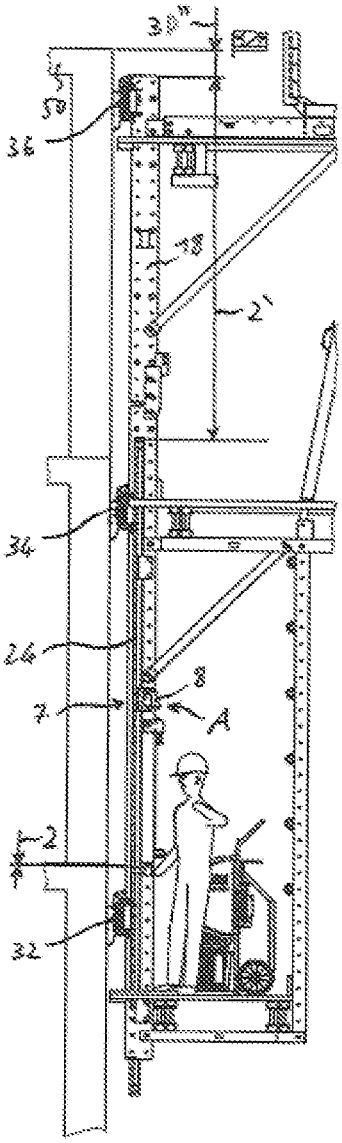
Figure 6H:
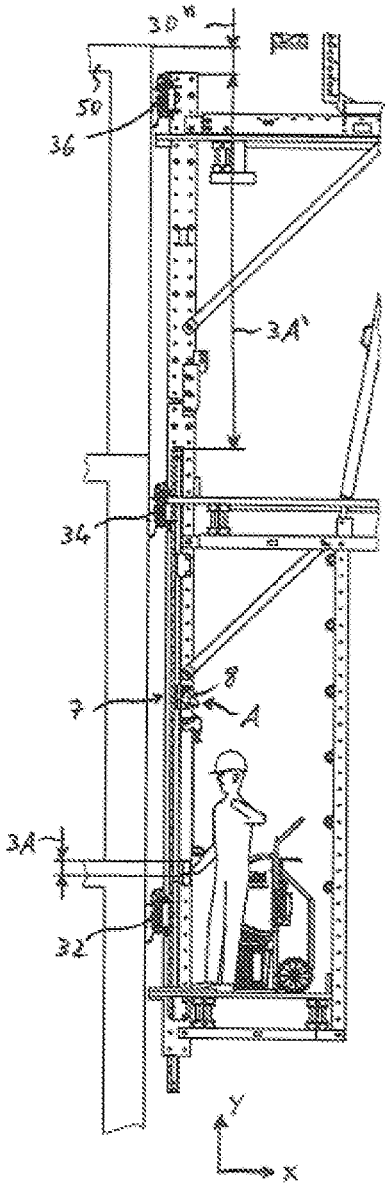
Figure 6I:
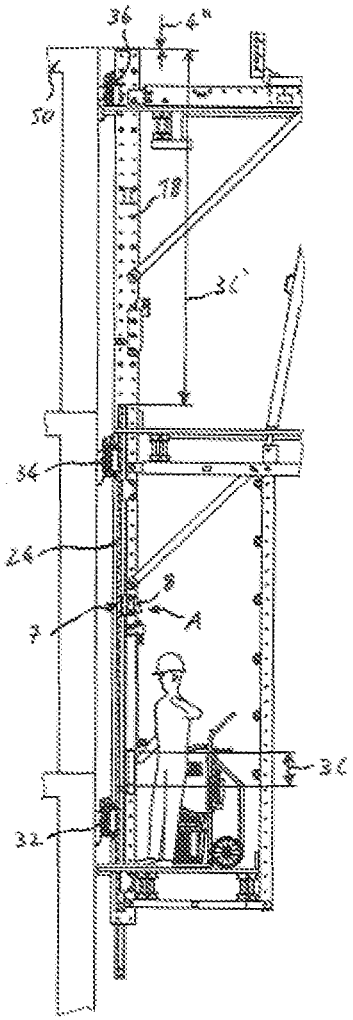
Figure 6J:
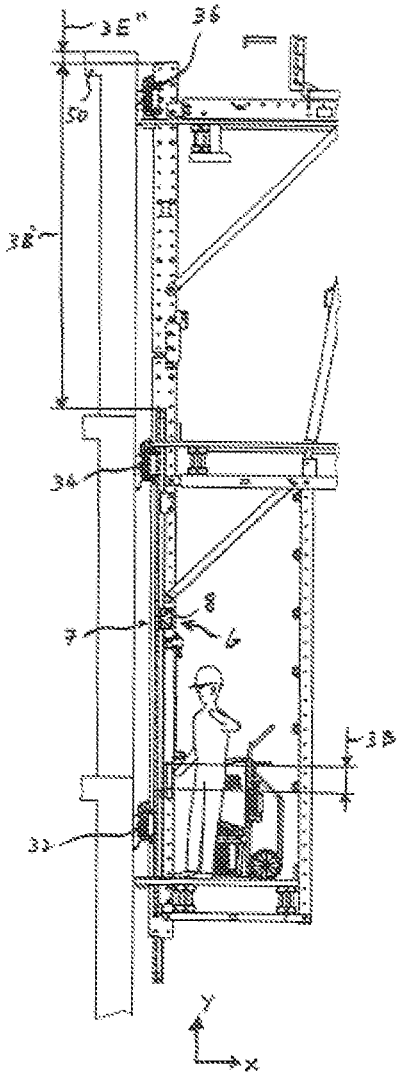
Figure 6K:
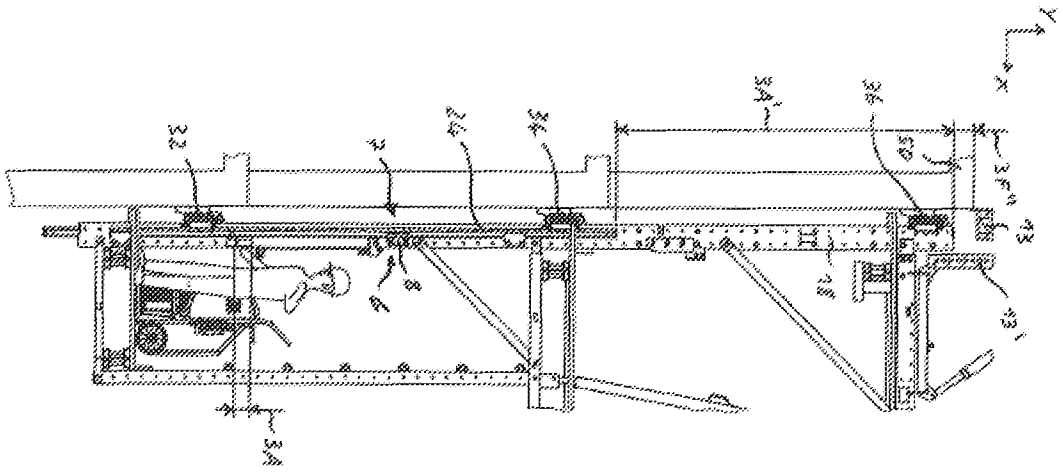

FIG. 6*a*-6*k* are side views of climbing states of the climbing system 10 shown in FIG. 1 with the fixing means 7 in the open position O in FIG. 6*a*-6*f*, in the applied position A in FIG. 6*g*-6*i*, and in the closed position G in FIGS. 6*j* and 6*k*. In FIG. 6*a*, the frame unit 11 of the climbing system 10 is suspended on the climbing shoe 34 via the climbing rail 18. The lifting device 26 is fully retracted and a stroke length 2 is zero. The fixing latch 8 faces away from the climbing lift rail 24, i.e., in the X direction, and is arranged with respect to the fixing flange 9 such that the fixing means 7 is in the open position O (see upper portions of each of FIG. 5*a*, 5*b*).

In FIG. 6*b*, the climbing lift rail 24 is moved in the negative Y direction, i.e., in the direction opposite the climbing direction, such that the climbing lift rail 24 is suspended on the climbing shoe 32. In this operating state of the assembly consisting of the climbing rail 18 and the climbing lift rail 24, the frame unit 11 is suspended on the climbing shoe 34 via the climbing rail 18 and additionally suspended on the climbing shoe 32 via the climbing lift rail 24. The lifting device 26 is supplied with energy via the hydraulic unit 6 such that the lifting device extends and a stroke length 3A greater than the stroke length 2 is present. A distance 3A' between the upper edge of the climbing rail 18 and the upper edge of the climbing lift rail 24 is greater by the stroke length 3A than the distance 2' in FIG. 6*a* between the upper edge of the climbing rail 18 and the upper edge of the climbing lift rail 24. A distance 3A" between the upper edge of the climbing rail 18 and the upper edge of the floor slab 50 in FIG. 6*b* is equal to the distance 2" in FIG.

6*a* because the climbing lift rail 24 is moved only in the direction opposite the climbing direction without changing the position of the climbing rail 18 relative to the floor slab 15 and thus to the building structure 1. The fixing means 7 having the fixing latch 8 is still in the open position.

In FIG. 6*c*, the lifting device 26 extends further and lifts the frame unit 11 attached to the climbing rail 18 in the climbing direction, i.e., in the Y direction because the climbing lift rail 24 is suspended on the climbing shoe 32. The stroke length 3*b* is therefore greater than the stroke length 3*a* in FIG. 3*b* and the distance 3B" from the upper edge of the climbing rail 18 to the upper edge of the floor slab 50 is smaller than the corresponding distance 3A" according to FIG. 6*b*. Since the climbing rail 18 is moved relative to the climbing lift rail 24 in the climbing direction due to the lifting device 26, the distance 3B' between the upper edge of the climbing rail 18 and the upper edge of the climbing lift rail 24 is greater than the corresponding distance 3A' in FIG. 6*b*. The fixing means 7 is still in the open position.

In FIG. 6*d*, the frame unit 11 is still suspended on the climbing shoe 32 by means of the climbing lift rail 24, wherein the stroke length 4 of the lifting device 26 is significantly increased when compared to the stroke length 3B according to FIG. 6*c*. Consequently, the distance 4' from the upper edge of the climbing rail 18 to the upper edge of the climbing lift rail 24 is greater than the distance 3B' from the upper edge of the climbing rail to the upper edge of the climbing lift rail according to FIG. 6*c* by the difference of the stroke lengths 4 and 3B. The difference of the stroke lengths 3B and 4 therefore means that the distance 4" between the upper edge of the climbing rail 18 and the upper edge of the floor slab 50, in contrast to the corresponding distance 3B" in FIG. 6*c*, is now zero. The fixing means 7 is still in the open position. A comparison of FIGS. 6*c* and 6*d* makes it clear that the climbing rail 18 in FIG. 6*d* has passed completely through the climbing shoe 36 in the Y direction and has thus traversed the climbing shoe travel path.

In FIG. 6*e*, the frame unit 11 is lowered onto the climbing shoe 36 by retracting the cylinder of the lifting device 26, and the frame unit 11 is thus suspended on the climbing shoe 36 via the climbing rail 18. The stroke length 3D is thus smaller than the stroke length 4 of the lifting device 26 in FIG. 6*d*, and the upper edge of the climbing rail is arranged below the upper edge of the floor slab such that the distance 3D" from the upper edge of the climbing rail 18 to the upper edge of the floor slab 50 corresponds approximately to a thickness of the floor slab 50. By traversing the climbing shoe travel path (see movement of the climbing rail 18 according to FIG. 6*c* to 6*d*) and a movement of the climbing rail 18 in the direction opposite the climbing direction, i.e., the negative Y direction, the climbing rail 18 is suspended on the climbing shoe 36. Due to the movement of the climbing rail 18 relative to the climbing lift rail 24 in the direction opposite the climbing direction, the distance 3D' from the upper edge of the climbing rail 18 to the upper edge of the climbing lift rail 24 is smaller than the corresponding distance 4' according to FIG. 6*d*. The fixing means 7 is still in the open position.

In FIG. 6*f*, the climbing lift rail 24 is completely retracted relative to the climbing rail 18, i.e., moved by the maximum stroke length of the lifting device 26 relative to the climbing rail 18, which is stationary with respect to the building structure 1, in the climbing direction, i.e., in the Y direction. Consequently, the stroke length 2 of the lifting device 26 is zero, as has already been shown in FIG. 6*a*. The distance 3D" between the upper edge of the climbing rail 18 and the upper edge of the floor slab 50 is unchanged according to the corresponding distance in FIG. 6*e* because the climbing rail is still suspended on the climbing shoe 36. On the other hand, the distance 2' from the upper edge of the climbing rail 18 to the upper edge of the climbing lift rail 24 is smaller by the stroke length 3D than the corresponding distance 3D' according to FIG. 6*e*. The fixing means 7 is still in the open position.

In FIG. 6*g*, the fixing latch 8 is applied to the side of the climbing lift rail 24 facing the fixing latch 8 such that the fixing means 7 is in the applied position A. The frame unit 11 is still suspended on the climbing shoe 36 via the climbing rail 18 and, in comparison to the position of the climbing lift rail 24 in relation to the climbing rail 18, there is no change in FIG. 6*g* to FIG. 6*f* such that the distance 2' from the upper edge of the climbing rail 18 to the upper edge of the climbing lift rail 24 and the distance 3D" from the upper edge of the climbing rail to the upper edge of the floor slab 50 are unchanged. Consequently, the lifting device is also still in the fully retracted state with the stroke length 2 being zero.

In FIG. 6*h*, a cylinder of the lifting device 26 is extended such that the climbing lift rail 24 absorbs a load in the climbing shoe 34. When comparing FIGS. 6*e* and 6*f*, it can be seen that an upper edge of the climbing lift rail has passed through the climbing shoe 34 and traversed the climbing shoe travel path. In comparison to FIG. 6*g*, it becomes clear in FIG. 6*h* that, with a stationary climbing rail, the climbing lift rail has moved in the direction opposite the climbing direction, i.e., the negative Y direction, so that the climbing lift rail 24 can be suspended on the climbing shoe 34 in order to absorb the vertical load of the frame unit 11 of the climbing system 10. Since the lower end of the lifting device is connected to the climbing lift rail and the upper end of the lifting device, correspondingly to the climbing rail, is stationary in relation to the building structure 1, the stroke length 3A is greater than the stroke length 2 according to FIG. 6*g* such that the climbing lift rail is moved in the direction opposite the climbing direction in order to be suspended with its upper portion on the climbing shoe 34. The fixing means 7 is still in the applied position A. While the distance 3D" from the upper edge of the climbing rail to the upper edge of the floor slab remains the same with respect to this distance in FIG. 6*d*, the distance 3A' from the upper edge of the climbing rail 18 to the upper edge of the climbing lift rail 24 is, with respect to the corresponding distance 2' according to FIG. 6*g*, increased by the stroke length 3A.

In FIG. 6*i*, the lifting device is extended further and the climbing system 10 is raised in the climbing direction in order to transfer the fixing means 7 from the applied position to the closed position. Since the frame unit 11 is suspended on the climbing shoe 34, the climbing rail is moved in the climbing direction by extending the lifting device with the stroke length 3C, which is greater than the stroke length 3A according to FIG. 6*h*, such that the distance 4" from the upper edge of the climbing rail to the upper edge of the floor slab is now zero in contrast to the corresponding distance 3D" according to FIG. 6*h*. Since the climbing lift rail is stationary in relation to the building structure 1 due to the suspended state of the climbing lift rail on the climbing shoe 34, the distance 3C' from the upper edge of the climbing rail to the upper edge of the climbing lift rail is, due the extension movement of the lifting device, increased when compared to the corresponding distance 3A' according to FIG. 6*h*. Since one of the fixing recesses 24' is not yet located at the level of the fixing lug of the fixing latch 8, the fixing means 7 is still in the applied position A.

In FIG. 6*j*, the frame unit 11 of the climbing system 10 is lowered by moving the climbing rail in the direction opposite the climbing direction, i.e., in the negative Y direction, with the climbing lift rail being stationary with respect to the building structure 1, to the extent that the fixation 7 is transferred from the applied position A to the closed position G. Since the vertical load of the climbing system 10 and in particular of the frame unit 11 is transferred into the building structure 1 via the climbing lift rail and the climbing shoe 34, the climbing shoes 32 and 36 are free of vertical loads. The lowering of the climbing rail relative to the climbing lift rail in the direction opposite the climbing direction is indicated by the fact that the stroke length 3B is smaller than the stroke length 3C according to FIG. 6*i*. The distance 3B' between the upper edge of the climbing rail and the upper edge of the climbing rail is smaller by the difference between the stroke lengths 3B and 3C than the corresponding distance 3C' according to FIG. 6*i*. The difference between the stroke lengths 3B and 3C is indicated by the distance 3E" between the upper edge of the climbing rail and the upper edge of the floor slab which, in contrast to the corresponding distance 4" according to FIG. 6*i*, does no longer equal zero. Immediately after the fixing lug 8' meshes with the fixing recess 24', which is arranged at the same height as the fixing lug 8', no load is absorbed by the closed fixation because the movement of the climbing lift rail 24 towards the climbing rail 18 in the climbing direction must continue until the underside the fixing lug 8' comes to rest on the fixing underside 24''' of the fixing recess 24'.

In FIG. 6*k*, the climbing rail is thus lowered in relation to the climbing lift rail suspended on the climbing shoe 34 until, after the fixing lug 8' meshes with the fixing recess 24', the underside of the fixing lug 8' rests on the fixing underside 24''', which faces the underside, of the fixing recess 24' meshing with the fixing latch 8 such that the vertical load of the frame unit 11 is diverted into the outer wall of the building structure 1 via the climbing rail 18, the fixing means 7, the climbing lift rail 24, and the climbing shoe 34. The distance 3F" between the upper edge of the climbing rail and the upper edge of the floor slab is consequently somewhat greater than the corresponding distance 3E" according to FIG. 6*j*. Since the climbing lift rail 24 rests opposite the floor slab 50, the climbing rail is offset by the distance 3A' from the upper edge of the climbing rail to the upper edge of the climbing lift rail, which is smaller than the corresponding distance 3B' according to FIG. 6*j*. After the fixing lug 8' meshes with the fixing recess 24' according to FIG. 6*j*, through which the closed position G of the fixing means 7 is effected, the climbing rail in FIG. 6*k* is moved, relative to the climbing lift rail, further in the direction opposite the climbing direction by the difference between the stroke lengths 3A and 3B according to FIG. 6*j* until the fixing lug 8' bears against the fixing underside 24''' of the fixing recess 24' in order to divert the vertical load of the frame unit 10 via the climbing lift rail 24 and the climbing shoe 34 into the outer wall of the building structure 1.

The last concreted concreting portion for creating the floor slab 50 has a stability that does not yet allow the climbing system 10 to be suspended on the climbing shoe 36. This state is avoided in that the climbing lift rail 24 is fixed to the climbing rail 18 by means of the fixing means 7 in the closed position G such that the vertical load is diverted into the building structure 1 not via the climbing shoe 36, but via the climbing shoe 34. In this way, the last concreted concreting portion is freed from the deflection of the vertical load of the climbing system and a further concreting portion which, in the Y direction, i.e., in the climbing direction, is adjacent to the last concreted concreting portion with the floor slab 50, can be started earlier. This is indicated in FIG. 6*k* by the fact that the formwork 13, which is mounted on the vertical beams 13', is moved in the negative X direction with respect to its position according to FIG. 6*j* such that further concreting can be continued. Therefore, a side of the formwork 13 facing the building structure 1 is aligned with the outer side of the last concreted concreting portion of the building structure 1.

It is also possible that, instead of suspending the climbing lift rail 24 on the climbing shoe 34, the climbing lift rail is suspended on the climbing shoe 32, which is located below the climbing shoe 34 in the direction opposite the climbing direction, i.e., in the negative Y direction. In the described embodiment according to FIG. 1 to 6, the upper edge of the climbing rail 18 is arranged above the upper edge of the climbing lift rail 24 in the climbing direction. It is also possible for the upper edge of the climbing rail 18 to be arranged below the upper edge of the climbing lift rail 24 in a direction opposite the climbing direction. In this case, a vertical load of the climbing system 10 can also be diverted into the building structure 1 via the fixing means 7 in the closed position G via the climbing rail 18 suspended on a climbing shoe such that a formwork 13 attached to the climbing lift rail 24 in the climbing direction above the climbing rail 18 can be used earlier for concreting the next concreting portion than would be the case if the fixing means 7 were not present and the climbing rail 18 or the climbing lift rail 24 were suspended on the climbing shoe that is attached to the last concreted concreting portion.

The features of the invention described with reference to the depicted embodiment, such as the tab 8'''' of the fixing latch 8 for mechanically actuating the fixing latch 8, can also be present in other embodiments of the invention, for example, a motor-driven fixing latch 8 for automatically operating the fixing means 7, unless otherwise stated or naturally prohibited for technical reasons.

LIST OF REFERENCE SIGNS

1 Building structure
2, 3, 3A, 3B, 3C, 3D, 4 Stroke length lifting device
2', 3A', 3B', 3C', 3D', 4' Distance upper edge climbing rail to upper edge
climbing lift rail
2", 3A", 3B", 3D", 3E", Distance upper edge climbing rail to upper edge
3F", 4" floor slab
6 Hydraulic unit
7 Fixing means
8 Fixing latch
8' Fixing lug
8" Elongated hole fixing latch
8''' Contact lug fixing latch
8'''' Tab fixing latch
9 Fixing flange
9' Axis of rotation
9" Stop
9''' Contact element
10 Climbing system
11 Frame unit
12 Formwork platform
13 Formwork
13' Vertical beam formwork
13" Railing formwork platform

16 Working platform
18 Climbing rail
19 Bore in climbing rail
19' Support bolt climbing rail
19" Guide shoe climbing rail for climbing lift rail
20 Suspension distance climbing rail
22 Trailing platform
24 Climbing lift rail
24A Distance between adjacent fixing recesses
24G Greatest distance between fixing recesses
24' Fixing recess
24" End face climbing lift rail
24'" Fixing underside fixing recess
26 Lifting device
27 Lower end lifting device
28 Upper end lifting device
32, 34, 36, 38 Climbing shoe
32' Limb climbing shoe
32" Climbing latch
40, 44, 48, 52 External wall building structure
42, 46, 50, 54 Floor slab
60 Suspension stroke distance climbing lift rail
61 Retaining recess
A Section FIG. 2*a*
F1 Load transfer in open position
F2 Load transfer in closed position
O Open position
A Applied position
G Closed position

The invention claimed is:

1. An assembly comprising of a climbing rail and a climbing lift rail, which can be moved relative to the climbing rail and is guided by the climbing rail, for a rail-guided climbing system usable as a climbing formwork, a climbing frame, a climbing protection wall, and/or a climbing working platform, wherein the rail-guided climbing system comprises climbing shoes that can be arranged on a building structure in a stationary manner and a lifting device having one end that is fixed to the climbing rail and an other end that is fixed to the climbing lift rail, wherein the climbing rail is guided by the climbing shoes, wherein the climbing rail and the climbing lift rail can each be suspended on at least one of the climbing shoes in the direction opposite a climbing direction and unhooked from the at least one of the climbing shoes in the climbing direction and moved relative to the at least one of the climbing shoes, wherein a fixing means is provided in order to fix the climbing rail and the climbing lift rail to each other in a reversibly releasable manner independently of a fixation to each other by means of the lifting device.

2. The assembly according to claim 1, in which the climbing rail and the climbing lift rail are coupled to each other in a manually or automatically fixable manner via the fixing means.

3. The assembly according to claim 1, in which the fixing means is designed as a latching or snap connection and comprises at least one latching or snap element and at least one retaining element for holding the at least one latching or snap element, wherein either the at least one latching or snap element and a plurality of the retaining elements or a plurality of the latching or snap elements and the at least one retaining element for holding the at least one latching or snap element of the plurality of latching or snap elements.

4. The assembly according to claim 3, in which the latching or snap element is designed as a movable element and to be pivotable, foldable or movable, in the form of a latch, the latch including one of a locking latch or fixing latch, a detent, a snap-in nose, a bolt, a locking bolt, or a slide.

5. The assembly according to claim 4, in which the retaining elements in the form of fixing recesses for meshing with the at least one latching or snap element fixed to the climbing rail are introduced one behind the other into the climbing lift rail, or retaining knobs are welded to the climbing lift rail.

6. The assembly according to claim 5, in which the climbing lift rail has the fixing recesses on at least one side such that the climbing lift rail is present in the form of a profile with a suspension contour, with teeth, or, where only the at least one latching or snap element is fixed to the climbing rail, the climbing lift rail has the fixing recesses in the form of completely edged holes, which are rectangular or square.

7. The assembly according to claim 5, in which the at least one latching or snap element fixed in or on the climbing rail is designed in the form of the fixing latch to mesh with at least one of the fixing recesses in the climbing lift rail.

8. The assembly according to claim 7, in which the fixing latch is rotatably connected to the climbing rail and, in a connected state is arranged on the climbing rail such that a fixing lug of the fixing latch, due to one of gravity, a spring force, an electrostatic force, a magnetic force and/or an electromagnetic force, can mesh with the at least one fixing recess for fixing the climbing lift rail to the climbing rail, when the at least one fixing recess is at the level of the fixing lug.

9. The assembly according to claim 8, in which the fixing latch is rotatably connected to the climbing rail such that the fixing lug of the fixing latch bears against an end face of the climbing lift rail facing the fixing lug when the at least one fixing recess is located above the level of the fixing lug or below the level of the fixing lug, but not at the level of the fixing lug.

10. The assembly according to claim 9, in which an elongated hole is provided in the fixing latch which, when the climbing lift rail is in a state fixed to the fixing means, has a vertical orientation with respect to the climbing rail, wherein a pin, in the form of a screw, fixed to the climbing rail, runs through the elongated hole such that the fixing latch is translationally and/or rotatorily coupled to the climbing rail.

11. The assembly according to claim 10, in which a stop fixed to the climbing rail is arranged in a fixed state above the fixing lug between the fixing latch and the climbing lift rail such that, when an underside of the fixing lug is placed on a fixing underside facing an underside of the at least one fixing recess in mesh with the fixing latch, the fixing latch is canted with respect to a stop underside of the stop and the fixing underside of the at least one fixing recess facing the underside of the fixing lug.

12. The assembly according to claim 10, in which, in a state of the climbing lift rail not fixed to the fixing means with respect to the climbing rail, in which the fixing lug protrudes from an end face of the climbing lift rail facing the fixing lug, a contact element on the climbing rail can be provided below the pin such that, when the fixing latch is positioned with the pin in an upper region of the elongated hole, the fixing latch bears against the contact element in order to protrude from the end face of the climbing lift rail facing the fixing lug.

13. The assembly according to claim 11, in which a fixing flange which is fixed to the climbing rail and comprises the pin and/or the stop and/or the contact element is arranged between the fixing latch and the climbing rail.

14. The assembly according to claim 13, in which the fixing flange and the pin and/or the stop and/or the contact element are integral with or connected to each other.

15. The assembly according to claim 6, in which a greatest distance between the fixing recesses arranged one behind the other in a longitudinal direction of the climbing lift rail corresponds at most to a maximum stroke length of the lifting device.

16. A rail-guided climbing system comprising an assembly according to claim 1, wherein an overall length of the climbing rail is sufficient to guide the climbing rail of at least two of the climbing shoes that are spaced apart from each other at a predetermined distance, the predetermined distance being one floor height.

17. A method for constructing a rail-guided climbing system, usable as a climbing formwork, a climbing frame, a climbing protection wall, and/or a climbing working platform, comprising:

providing a climbing rail and a climbing lift rail such that the climbing lift rail can be moved relative to the climbing rail and is guided by the climbing rail, arranging climbing shoes on a building structure in a stationary manner, fixing a lifting device to the climbing rail at one end and to the climbing lift rail at the other end, guiding the climbing rail by the climbing shoes such that the climbing rail and the climbing lift rail are each suspended on at least one of the climbing shoes in the direction opposite a climbing direction and are unhooked from the at least one climbing shoe in the climbing direction and moved relative to the at least one climbing shoe, and providing a fixing means such that the climbing rail and the climbing lift rail can be fixed to each other in a reversibly releasable manner independently of a fixation to each other by means of the lifting device.

18. A method for climbing a rail-guided climbing system, usable as a climbing formwork, a climbing frame, a climbing protection wall, and/or a climbing working platform, having an assembly comprising of a climbing rail and a climbing lift rail according to claim 8 and comprising:

applying the fixing latch rotatably connected to the climbing rail on an end face of the climbing lift rail facing the fixing lug, wherein the fixing recess is located above the level of the fixing lug or below the level of the fixing lug, but not at the level of the fixing lug, extending the lifting device with the climbing rail, wherein the climbing lift rail is moved against the climbing direction relative to the climbing rail until the climbing lift rail is suspended, continuing the extension movement of the lifting device, wherein a further movement of the climbing lift rail against the climbing direction is prevented by a completed suspension of the climbing lift rail, and the climbing rail is unhooked and moved relative to the climbing lift rail in the climbing direction until the fixing lug of the fixing latch meshes with the at least one fixing recess for fixing the climbing lift rail with respect to the climbing rail, wherein the at least one fixing recess is located at the level of the fixing lug, and retracting the lifting device, wherein the climbing rail is moved against the climbing direction relative to the climbing lift rail until the fixing lug of the fixing latch, which meshes with the at least one fixing recess, absorbs a load of the rail-guided climbing system suspended on the climbing rail.

19. A method for climbing a rail-guided climbing system, usable as a climbing formwork, a climbing frame, a climbing protection wall, and/or a climbing working platform, having an assembly comprising a climbing rail and a climbing lift rail according to claim 8 and comprising:

extending the lifting device with the climbing rail, wherein the climbing lift rail is moved against the climbing direction relative to the climbing rail until the climbing lift rail is suspended, continuing the extension movement of the lifting device, wherein a further movement of the climbing lift rail against the climbing direction is prevented by a completed suspension of the climbing lift rail, and the climbing rail is unhooked and moved relative to the climbing lift rail in the climbing direction, by at least one suspension distance of the climbing rail and additionally by a climbing shoe travel path, retracting the lifting device, wherein the climbing rail is moved against the climbing direction relative to the climbing lift rail until the climbing rail is suspended offset in the climbing direction by at least one suspension distance, continuing the retraction movement of the lifting device, wherein a further movement of the climbing rail against the climbing direction is prevented by the completed suspension of the climbing rail, and the climbing lift rail is unhooked and moved relative to the climbing rail in the climbing direction by the at least one suspension distance of the climbing rail, applying the fixing latch rotatably connected to the climbing rail on an end face of the climbing lift rail facing the fixing lug, wherein the at least one fixing recess is located above the level of the fixing lug or below the level of the fixing lug, but not at the level of, the fixing lug, extending the lifting device, wherein a further movement of the climbing lift rail against the climbing direction is prevented after a completed suspension of the climbing lift rail, and the climbing rail is unhooked and moved relative to the climbing lift rail in the climbing direction until the fixing lug of the fixing latch, due to gravity, meshes with the at least one fixing recess for fixing the climbing lift rail with respect to the climbing rail, wherein the fixing recess is located at the level of the fixing lug, and retracting the lifting device, wherein the climbing rail is moved against the climbing direction relative to the climbing lift rail until the fixing lug of the fixing latch, meshed with the at least one fixing recess, absorbs a load of the rail-guided climbing system suspended on the climbing rail.

* * * * *